US007624723B2

(12) United States Patent
Gardner, Jr. et al.

(10) Patent No.: US 7,624,723 B2
(45) Date of Patent: Dec. 1, 2009

(54) PAINTBALL GUN KIT

(75) Inventors: William Gardner, Jr., Latrobe, PA (US); Danial Jones, Latrobe, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 540 days.

(21) Appl. No.: 11/155,415

(22) Filed: Jun. 17, 2005

(65) Prior Publication Data

US 2006/0011187 A1 Jan. 19, 2006

Related U.S. Application Data

(63) Continuation-in-part of application No. 11/056,938, filed on Feb. 11, 2005, now Pat. No. 7,556,032, and a continuation-in-part of application No. 10/869,829, filed on Jun. 15, 2004.

(51) Int. Cl.
*F41B 11/00* (2006.01)

(52) U.S. Cl. ..... 124/1; 124/80; 124/56

(58) Field of Classification Search ..... 124/1, 124/56, 71–77, 80

See application file for complete search history.

(56) References Cited

U.S. PATENT DOCUMENTS

| | | | | |
|---|---|---|---|---|
| 2,304,320 | A | 12/1942 | Tratsch | 124/77 |
| 2,554,116 | A | 5/1951 | Monner | 124/11 |
| 2,568,432 | A | 9/1951 | Cook | 124/77 |
| 2,594,240 | A | 4/1952 | Wells | 124/13 |
| 2,634,717 | A | 4/1953 | Junkin | 124/11 |
| 2,834,332 | A | 5/1958 | Guthrie | 124/77 |
| 2,845,055 | A | 7/1958 | Collins et al. | 124/32 |
| 2,845,805 | A | 7/1958 | Collins et al. | 124/77 |
| 3,089,476 | A | 5/1963 | Wolverton | 124/77 |
| 3,192,915 | A | 7/1965 | Norris et al. | 124/77 |
| 3,662,729 | A | 5/1972 | Henderson | 124/73 |
| 3,685,828 | A * | 8/1972 | Getgey et al. | 273/356 |
| 3,695,246 | A | 10/1972 | Filippi et al. | 124/77 |

(Continued)

FOREIGN PATENT DOCUMENTS

| | | |
|---|---|---|
| EP | AN94026535 | 2/1993 |

(Continued)

OTHER PUBLICATIONS

Paintball Products: SmartParts Total Feak Kit Alu, http://www.xtremez.com/paintball/html/I-BRSFT.html, retrieved Jul. 15, 2007.*

(Continued)

*Primary Examiner*—Troy Chambers
(74) *Attorney, Agent, or Firm*—Simple IP Law, P.C.; Craig R. Rogers

(57) ABSTRACT

A paintball gun kit preferably includes a plurality of non-fully assembled paintball gun components packaged for retail sale to a consumer. Instructions are preferably provided to instruct the consumer how to assemble the paintball gun components into an operational paintball gun. The paintball gun components can be packaged together or separately. The paintball gun kit can include, for example, a body, a grip, and a pneumatic assembly. Various numbers and arrangements of components are contemplated. Various styles, materials, and colors of paintball gun components can also be provided consistent with the principles of the present invention.

14 Claims, 19 Drawing Sheets

U.S. PATENT DOCUMENTS

| | | | | | |
|---|---|---|---|---|---|
| 3,915,143 | A | | 10/1975 | Waller | 124/11 R |
| 3,921,980 | A | | 11/1975 | Artzer | 124/77 |
| 4,009,536 | A | | 3/1977 | Wolff | 42/84 |
| 4,094,294 | A | | 6/1978 | Speer | 124/56 |
| 4,269,163 | A | | 5/1981 | Feith | 124/77 |
| 4,338,909 | A | * | 7/1982 | Plummer | 124/16 |
| 4,362,145 | A | | 12/1982 | Stelcher | 124/32 |
| 4,730,407 | A | | 3/1988 | DeCarlo | 42/84 |
| 4,770,153 | A | | 9/1988 | Edelman | 124/77 |
| 4,819,609 | A | | 4/1989 | Tippmann | 124/72 |
| 4,899,717 | A | | 2/1990 | Rutten et al. | 124/32 |
| 4,936,282 | A | | 6/1990 | Dobbins et al. | 124/74 |
| 5,063,905 | A | | 11/1991 | Farrell | 124/72 |
| 5,083,392 | A | | 1/1992 | Bookstaber | 42/84 |
| 5,228,427 | A | | 7/1993 | Gardner, Jr. | 124/71 |
| 5,261,384 | A | | 11/1993 | Hu | 124/66 |
| 5,280,778 | A | | 1/1994 | Kotsiopoulos | 124/73 |
| 5,285,765 | A | | 2/1994 | Lee | 124/50 |
| 5,333,594 | A | | 8/1994 | Robinson | 124/73 |
| 5,337,726 | A | | 8/1994 | Wood | 124/61 |
| 5,349,938 | A | | 9/1994 | Farrell | 124/73 |
| 5,383,442 | A | | 1/1995 | Tippmann | 124/76 |
| 5,413,083 | A | | 5/1995 | Jones | 124/32 |
| 5,462,042 | A | | 10/1995 | Greenwell | |
| 5,515,838 | A | | 5/1996 | Anderson | 124/76 |
| 5,613,483 | A | | 3/1997 | Lukas et al. | 124/73 |
| 5,878,736 | A | | 3/1999 | Lotuaco, III | 124/71 |
| 5,881,707 | A | | 3/1999 | Gardner, Jr. | 124/77 |
| 5,967,133 | A | | 10/1999 | Gardner, Jr. | 124/77 |
| 6,003,504 | A | | 12/1999 | Rice et al. | 124/73 |
| 6,035,843 | A | | 3/2000 | Smith et al. | 124/77 |
| 6,142,136 | A | | 11/2000 | Velasco | |
| 6,343,599 | B1 | | 2/2002 | Perrone | 124/33 |
| 6,349,711 | B1 | | 2/2002 | Perry et al. | 124/73 |
| 6,474,326 | B1 | | 11/2002 | Smith et al. | 124/77 |
| 6,516,791 | B2 | | 2/2003 | Perrone | 124/77 |
| 6,520,172 | B2 | | 2/2003 | Perrone | 124/74 |
| 6,618,975 | B1 | | 9/2003 | Shih | |
| 6,637,421 | B2 | | 10/2003 | Smith et al. | 124/77 |
| 6,644,295 | B2 | * | 11/2003 | Jones | 124/77 |
| 6,644,296 | B2 | | 11/2003 | Gardner, Jr. | 124/77 |
| 6,668,815 | B1 | * | 12/2003 | Fernandez | 124/83 |
| 6,749,170 | B1 | * | 6/2004 | Rhoads | 248/545 |
| 6,772,694 | B1 | * | 8/2004 | Pearce | 102/502 |
| 6,877,499 | B1 | * | 4/2005 | Otto | 124/7 |
| 2001/0050077 | A1 | * | 12/2001 | Sullivan, Jr. | 124/84 |
| 2002/0096164 | A1 | | 7/2002 | Perrone | 124/77 |
| 2002/0170551 | A1 | | 11/2002 | Kotsiopoulos et al. | 124/54 |
| 2003/0000511 | A1 | * | 1/2003 | Moritz | 124/73 |
| 2003/0005918 | A1 | | 1/2003 | Jones | 124/70 |
| 2005/0087180 | A1 | * | 4/2005 | Hayes | 124/1 |
| 2005/0091901 | A1 | | 5/2005 | Perry et al. | |
| 2005/0115554 | A1 | | 6/2005 | Jones | |
| 2006/0236993 | A1 | * | 10/2006 | Cucjen et al. | 124/78 |

FOREIGN PATENT DOCUMENTS

| | | |
|---|---|---|
| GB | 2146416 | 4/1985 |
| GB | 2313655 | 12/1997 |
| JP | 1179898 | 7/1989 |
| JP | 7004892 | 1/1995 |
| WO | WO 97/26498 | 6/1997 |

OTHER PUBLICATIONS

Paintball Products: Spyder Deluxe Rear Cocking Kit, http://www.xtremez.com/paintball/html/CKRCSP.html, retrieved Jul. 15, 2007.*

Rebel Basic Paintball Kit, http://www.onlinesports.com/pages/I,NPS-003.html, retrieved Jul. 15, 2007.*

Game Face Paintball Ready to Play Kit, http://www.gamefacepaintball.com/rtpkit.html, retrieved Jul. 15, 2007.*

Matrix-Main Body Assembly & Parts Listing at http://www.directpaintball.com/pics/diablomatrix/matrixparts.gif. 3 pages.

Techno Paintball-information reviews articles forum auction and chat at http://www.technopaintball.com/matrixreview.htm 2 pages.

* cited by examiner

PAINTBALL GUN KIT

This application is a continuation-in-part of U.S. patent application Ser. No. 11/056,938, filed Feb. 11, 2005, now U.S. Pat. No. 7,556,032, and a continuation-in-part of U.S. patent application Ser. No. 10/869,829, filed Jun. 15, 2004, the contents of each of which are incorporated herein by reference, in their entirety.

BACKGROUND OF THE INVENTION

1. Field of the Invention

This invention relates generally to pneumatic paintball guns ("markers") and their operating components. More particularly, this invention relates to a pneumatic paintball gun and the pneumatic components used to load a paintball into and fire it from the paintball gun. This invention further relates to an arrangement and method for selling the paintball gun to an end user.

2. Related Art

In the sport of paintball, it is generally desirable to have a marker that is as small and light as possible. Smaller and lighter markers increase a players' mobility. Players benefit from increased mobility by being able to move more quickly from bunker to bunker, making it easier to avoid being hit. Further, in the sport of paintball, the marker is treated as an extension of the body such that a hit to the marker counts as a hit to the player. It is desirable, therefore, to have a paintball gun with as small a profile as possible while substantially maintaining or improving performance characteristics of the marker, such as firing rate, accuracy, and gas efficiency. The size of the paintball gun is generally related to the size and number of operating components that must be housed within the paintball gun body.

It is further desirable to have a paintball marker that includes fewer, less complex, and less expensive, operating components and that can be more easily manufactured. The cost savings can then be passed on to the consumer. The industry is in need of a small, light, and inexpensive paintball marker that provides reliable and efficient operation.

Conventional paintball markers may also be complex and difficult for end users to maintain or repair. The industry is further in need of a fairly simple and straightforward paintball gun design capable of high speeds of operation that is also easy to construct and maintain. The industry would further be benefited by an arrangement and method for conveying the paintball gun to an end user in a way that would better facilitate their understanding of the components, construction, and operation of the paintball gun.

SUMMARY OF THE INVENTION

In one embodiment of the present invention, a pneumatic paintball gun can include a body and a grip frame. The body and the grip frame can be formed separately or integrally, and are preferably formed from a molded plastic, rubber, or other rugged but relatively inexpensive material. The body preferably includes a chamber configured to receive a pneumatic assembly. The pneumatic assembly preferably provides several of the operating components of the paintball gun including a bolt, a compressed gas storage area, and a firing mechanism. A pneumatic assembly housing can be formed of metal, plastic, or a combination of materials and, in addition to housing the pneumatic components, can be configured to receive a barrel and a feed tube. A pneumatic regulator can also be provided and can, for example, be a vertical, in-line regulator or a bottom-mount regulator.

The bolt preferably includes a forward and a rearward piston surface area. A quantity of compressed gas is preferably selectively supplied and vented from a forward piston surface area through a mechanical or electro-pneumatic valving mechanism. The firing mechanism preferably consists of a sealing member arranged in selective communication with an outer surface of the bolt. One or more firing ports are preferably arranged in the bolt to communicate compressed gas through the bolt to launch a paintball. Compressed gas from the regulator can be supplied to the compressed gas storage area through a supply port. The flow of compressed gas into the compressed gas storage area can be restricted or prevented during a firing operation to increase gas efficiency of the paintball gun.

In operation, compressed gas is preferably supplied to the paintball gun from a compressed gas container through a pressure regulator. The compressed gas is preferably directed from the pressure regulator to the valving mechanism and to a supply port for feeding the compressed gas storage area. Compressed gas supplied to the valving mechanism is preferably transferred through the valving mechanism to the forward surface area of the bolt piston when the valving mechanism is in a neutral (non-actuated) position. This compressed gas acts on the forward bolt piston surface area to force the bolt into a rearward position. While the bolt is in a rearward position, a paintball is allowed to load into a breech of the paintball gun from the feed tube. In addition, while the bolt is rearward, the gas supply port is preferably allowed to rapidly transmit compressed gas into the compressed gas storage area.

A trigger mechanism is preferably configured to operate the valving mechanism. When the trigger is depressed, the valving mechanism is preferably actuated to vent compressed gas away from the forward piston surface area of the bolt. Compressed gas is preferably applied to a rearward surface area of the bolt piston. The rearward surface area of the bolt piston can be arranged, for example, in the compressed gas storage area or at a rearward end of the bolt. The compressed gas applied to the rearward surface area of the bolt piston can therefore be supplied from the compressed gas storage area or from a separate supply port. When the compressed gas is vented from the forward bolt piston surface area, the pressure applied to the rearward bolt piston surface area preferably causes the bolt to move to a forward position.

When the bolt transitions to its forward position, a sealing member of the firing mechanism preferably disengages from the bolt surface area, permitting compressed gas from the compressed gas storage area to enter the bolt firing ports and launch a paintball from the marker. In addition, with the bolt in the firing position, the flow of compressed gas into the compressed gas storage area can be restricted. This can be accomplished, for instance, by configuring a rearward portion of the bolt to reduce the area through which compressed gas travels from the supply port to the compressed gas storage area. Alternatively, the supply of compressed gas to the compressed gas storage chamber can be cut off completely to prevent compressed gas from entering the storage chamber during the firing operation. This can be accomplished, for instance, by closing off the gas supply port using sealing members on a rearward end of the bolt, using sealing members on a separate, independent piston, by pinching a gas supply tube, or using a separate valving mechanism.

The valving mechanism can be a solenoid valve (such as a three-way solenoid valve), a mechanical valve, or other valving mechanism. In the case of a solenoid valve, an electronic circuit is preferably provided to control the operation of the solenoid valve based on actuation of a trigger mechanism. A switch, such as a microswitch or other switching device, is preferably arranged in communication with the trigger to send an actuation signal to the electronic circuit in response to a pull of the trigger. A power source is also preferably provided to supply power to the electronic circuit and solenoid valve. The valving mechanism preferably vents compressed gas away from a forward bolt piston surface area in response to a firing signal from the circuit board. In the case of a mechanical valve, the mechanical valve preferably communicates with the trigger to vent the compressed gas away from the forward bolt piston surface area in response to a trigger pull.

In one embodiment, the bolt is preferably a free-floating bolt with balanced pressure applied to opposite ends of the bolt piston rod. This can be accomplished, for instance, by providing a vent channel from a rearward end of the bolt piston rod through to the forward end of the bolt. Alternatively, the chamber in communication with the rearward end of the bolt piston can be vented to atmosphere through a vent port arranged through the gun body.

According to another aspect of this invention, ribs or fins can be provided lengthwise on the bolt piston with firing channels arranged between the ribs to permit compressed gas to be released from the gun when the bolt is transitioned forward, while still maintaining the position of the sealing member in a retaining groove.

According to a further aspect of this invention, an interchangeable shell can form the outer portion of the paintball gun body surrounding the pneumatic components. The interchangeable shell can, for instance, be a plastic, metal, or composite material, but is preferably ABS plastic. A number of interchangeable shells can be provided of different shapes, colors, and body styles to permit a user to customize their gun to a desired appearance.

According to a still further aspect of this invention, an improved apparatus and method for grip mounting a circuit board can be provided. According to this method, one or more slots are preferably arranged in the grip frame to receive the circuit board. Most preferably, one slot is arranged on each side of the grip frame to receive opposing sides of the circuit board. The depth of the slots is preferably selected to arrange the circuit board in the appropriate location when the circuit board is fully inserted into the slots. In this embodiment, no tools or mounting screws are required to secure the circuit board in the paintball gun, thereby reducing the cost of parts and the cost of manufacturing. Manufacturing consistency is also improved. In addition, a solenoid valve can be mounted on the circuit board and arranged in the grip of the paintball gun. The circuit board can further include a trigger-actuated microswitch arranged on the circuit board, preferably on an opposite side of the circuit board from the solenoid valve.

According to another aspect of the present invention, a method of mounting a paintball detection system is provided. According to this method, a mounting slot is preferably arranged in a bottom portion of a pneumatic housing near a breech area of a paintball gun. Holes or slots are preferably arranged through one or more sidewalls of the pneumatic housing at the breech area. A paintball detection system circuit board is preferably mounted within the slot such that a sensor disposed on the circuit board can communicate with an interior of the breech area or with a sensor arranged on an opposite side of the pneumatic housing. The circuit board is preferably shaped to fit within the mounting slot. If a break-beam sensor system is used, holes are preferably arranged in opposing sides of the pneumatic housing in proximity to the location of the break-beam sensors once installed in the pneumatic housing.

According to yet another aspect of the present invention, the paintball gun may be arranged and sold to an end user in component, or "kit" form. All of the necessary operating components could be arranged in a single package or multiple packages to allow a user to buy the paintball gun kit and construct the paintball gun themselves. In this manner, a user will gain an increased familiarity with the paintball gun and its manner of construction and operation. The paintball gun will thereby be easier for them to troubleshoot and maintain. Providing a "kit" form of a paintball gun also allows for greater user customization, multiple packaging configurations, and a greater variety in price points to consumers. Reduction in labor costs by removing assembly from the manufacturing process allows the gun kit to be sold to consumers for a lower price than the fully-constructed marker. The paintball gun kits could be sold in partially assembled or completely disassembled forms. The paintball gun kits could further be sold in many different configurations, with different upgrade options, body styles, material components, etc., in order to meet the desires and price ranges of a wider variety of consumers.

Various other aspects, embodiments, and configurations of this invention are also possible without departing from the principles disclosed herein. This invention is therefore not limited to any of the particular aspects, embodiments, or configurations described herein.

BRIEF DESCRIPTION OF THE DRAWINGS

The foregoing and additional objects, features, and advantages of the present invention will become more readily apparent from the following detailed description of preferred embodiments, made with reference to the accompanying figures, in which.

DETAILED DESCRIPTION OF PREFERRED EMBODIMENTS

Figure 1:
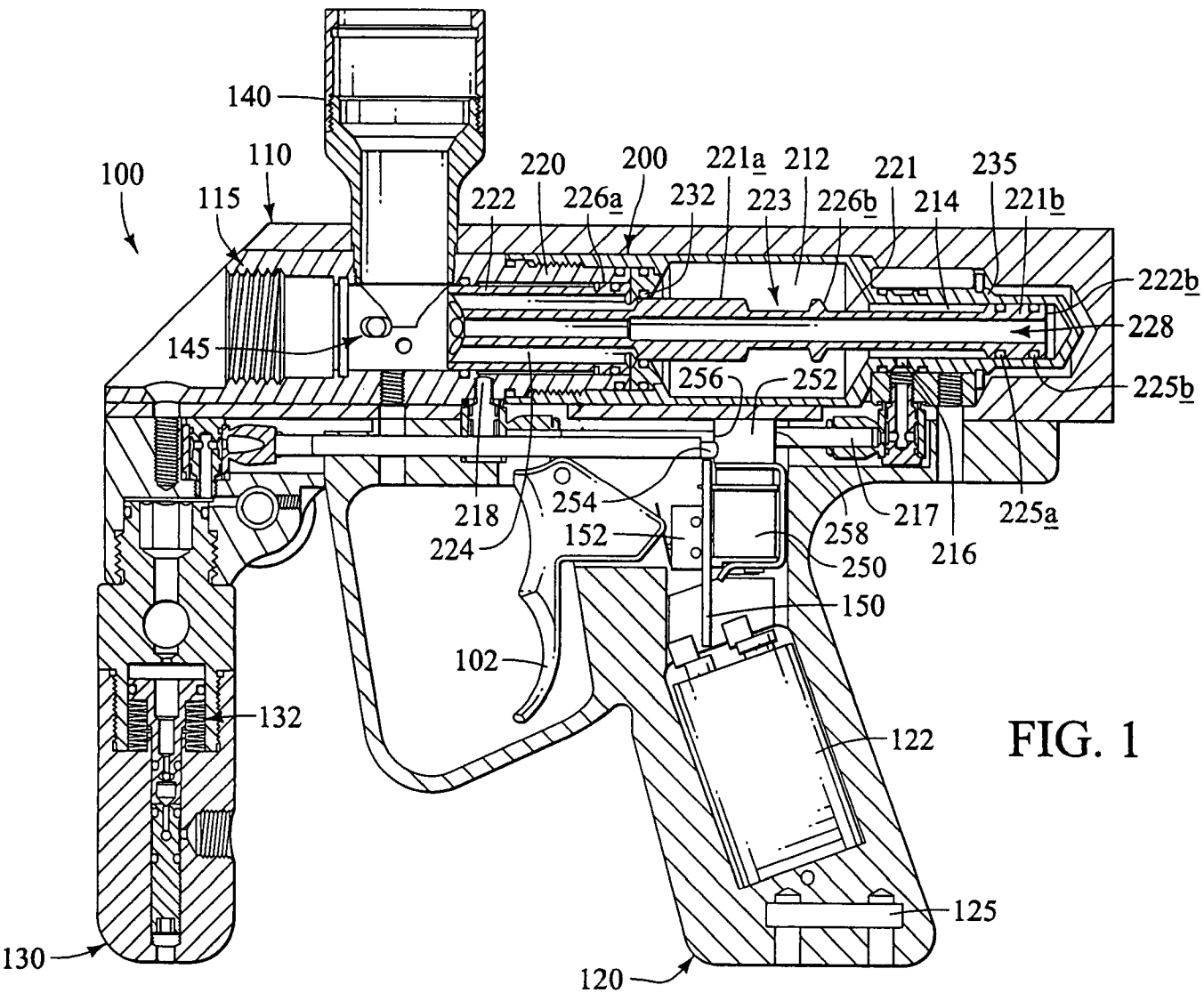
FIG. 1 is a somewhat schematic cross-sectional side view of a paintball gun, shown with a bolt thereof in an rearward (e.g., open) position, according to certain principles of the present invention.

The accompanying drawings show the construction of various preferred embodiments incorporating principles of the present invention. Referring to FIG. 1, a pneumatic paintball gun 100 can be constructed having a body 110 and a grip 120. A foregrip 130 can also be provided. The body 110 and the grip 120 can be formed integrally or separately and can be formed of the same or different materials. The body 110 and the grip 120 are preferably formed of a molded plastic or rubber material, such as ABS plastic, that is durable and shock resistant yet relatively inexpensive.

A pneumatic housing 115 is preferably arranged in the body 110 to house some or all of the pneumatic components, to receive a barrel (not shown), and to receive a feed tube 140. The pneumatic housing 115 is preferably a block or tube formed from a metal such as aluminum, but can be formed of any other metal, plastic, or other material that is sufficiently durable to perform its required functions. The grip 120 and foregrip 130 are preferably secured to the body 110 and the pneumatic housing 115 using screws or other fastening means. A plate 125 is also preferably provided and formed of a rigid material, such as metal, can also be arranged in the grip 120 to permit secure attachment of a tank receptacle (not shown) for connecting to a compressed gas tank.

The foregrip 130 preferably provides a regulator 132 for regulating a supply of compressed gas down to a desired operating pressure. In this embodiment, the desired operating pressure is between about 90 to 350 psi. A battery 122 can be arranged in the grip 120 along with a circuit board 150 and a solenoid valve 250. The solenoid valve 250 of this embodiment is preferably a normally-open, three-way solenoid valve.

A pneumatic assembly 200 is preferably arranged in the body 110 and can be connected to and/or include some or all of the pneumatic housing 115. The pneumatic assembly 200 preferably includes a compressed gas storage area 212, a pneumatic cylinder 220, and a guide chamber 214. A bolt 222 is preferably slidably arranged having a first piston surface area 226*a* located within a pneumatic cylinder 220 in a piston and cylinder assembly. The bolt 222 may further include a guide rod 221 that extends through substantially the entire pneumatic assembly 200.

The guide rod 221 can include a firing valve section 221*a* that communicates with a sealing member 232 to prevent compressed gas from entering the bolt 222 from the compressed gas storage area 212 when the bolt 222 is rearward. The guide rod 221 further preferably includes a rearward section 221*b* that slides back and forth within a guide chamber 214 to provide stability for the bolt and also to restrict or prevent the flow of compressed gas into the compressed gas storage area 212 from a supply port 216 when the bolt 222 is forward. A vent channel 228 may be provided through the bolt 222 and guide rod 221 to prevent back pressure from building up on a rearward end 222*b* of the bolt 222 and provide an essentially free-floating bolt arrangement. This reduces the amount of pressure required to recock the bolt 222. The vent channel also reduces the amount of force applied by a forward end 222*a* of the bolt 222 on a paintball, improves gas efficiency, and eliminates the need for a secondary pressure regulator.

Alternatively, a vent channel (not shown) may be provided through the body 110 of the gun 100 to vent the rearward chamber area 214 to atmosphere.

With the bolt 222 in an open position, compressed gas from the regulator 132 is supplied to the compressed gas storage area 212 through the supply port 216. The sealing member 232 preferably communicates between an external surface of the bolt 222 along the firing valve section 221*a* and an inner wall of the pneumatic assembly 200 to prevent compressed gas from entering the bolt 222. The sealing member 232 can, for example, be arranged in a recess of the inner wall (or protrusion from the inner wall) of the pneumatic assembly 200 near a forward end of the compressed gas storage chamber 212.

Alternatively, for example, a bolt port can be arranged through the bolt 222, with an input disposed near a rearward end of the bolt 222, to communicate compressed gas from a rearward end of the compressed gas storage area 212 through the bolt 222 and into communication with a paintball when the bolt transitions to its forward position. In this embodiment, the sealing member 232 could be arranged on the bolt 222 near a rearward end of the compressed gas storage area 212 so as to prevent compressed gas from entering the bolt 222 from the compressed gas storage area 212 when the bolt 222 is open, but to permit compressed gas from the compressed gas storage area 212 to enter the bolt 222 when the bolt is closed.

The solenoid valve 250 preferably selectively supplies compressed gas to and vents compressed gas from the cylinder 220 through the port 218 to move the bolt 222. The solenoid valve 250 preferably comprises a normally-open configuration where compressed gas input into the solenoid valve 250 through an input port 254 is supplied via an output port 256 to the forward piston surface area 226*a* of the bolt 222 to hold the bolt 222 in an open position.

Figure 9:
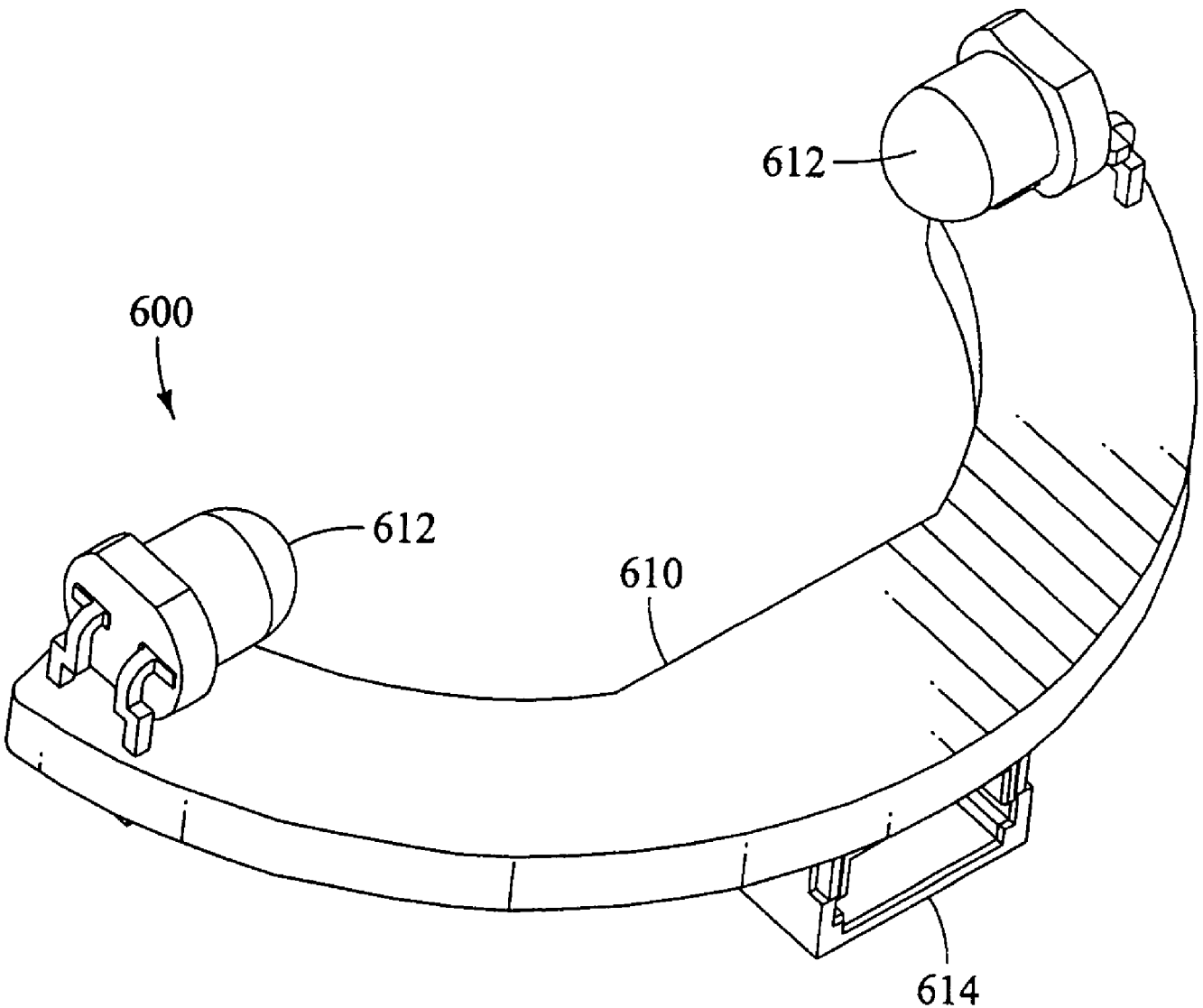
FIG. 9 is a somewhat schematic perspective view of a circuit board and sensor system for the paintball detection system configured for arrangement in the breech section of the paintball gun illustrated in FIGS. 6, 7, and 8.

In response to a trigger pull, a firing signal is preferably sent from the circuit board 150 to the solenoid valve 250 to initiate a firing operation of the paintball gun 100. In response to the firing signal, the solenoid valve 250 preferably vents compressed gas away from the forward piston area 226*a* of the bolt 222. Pressure on an opposing surface area 226*b* of the bolt 222 thereby causes the bolt 222 to transition to a closed position, as shown in FIG. 9. The opposing surface area 226*b* can, for instance, be arranged in the compressed gas storage area 212 as shown in FIGS. 1 and 2.

Alternatively, the opposing surface area 226*b* can be arranged on a rearward end 222*b* of the bolt 222, with compressed gas supplied to the rearward end 222*b* of the bolt 222 through a separate supply channel (not shown). In this alternative embodiment, the vent channel 228 would be omitted to maintain pressure in chamber 214 to function as an air spring. The opposing surface area 226*b* could likewise be positioned anywhere else where it can receive a quantity of compressed gas to force the bolt 222 into a closed position when gas is vented away from the forward surface area 226*a*. The opposing surface area 226*b* preferably has a surface area less than that of the forward surface area 226*a* to prevent the bolt from moving forward until the compressed gas is vented away from the forward surface area 226*a*. Alternatively, a mechanical spring or other biasing member that provides a desired amount of force (preferably less than the amount of force created by the compressed gas on the forward surface area of the bolt 226*a*) could be used to force the bolt 222 into a closed position when compressed gas is vented away from the forward surface area 226*a* of the bolt 222.

Figure 2:
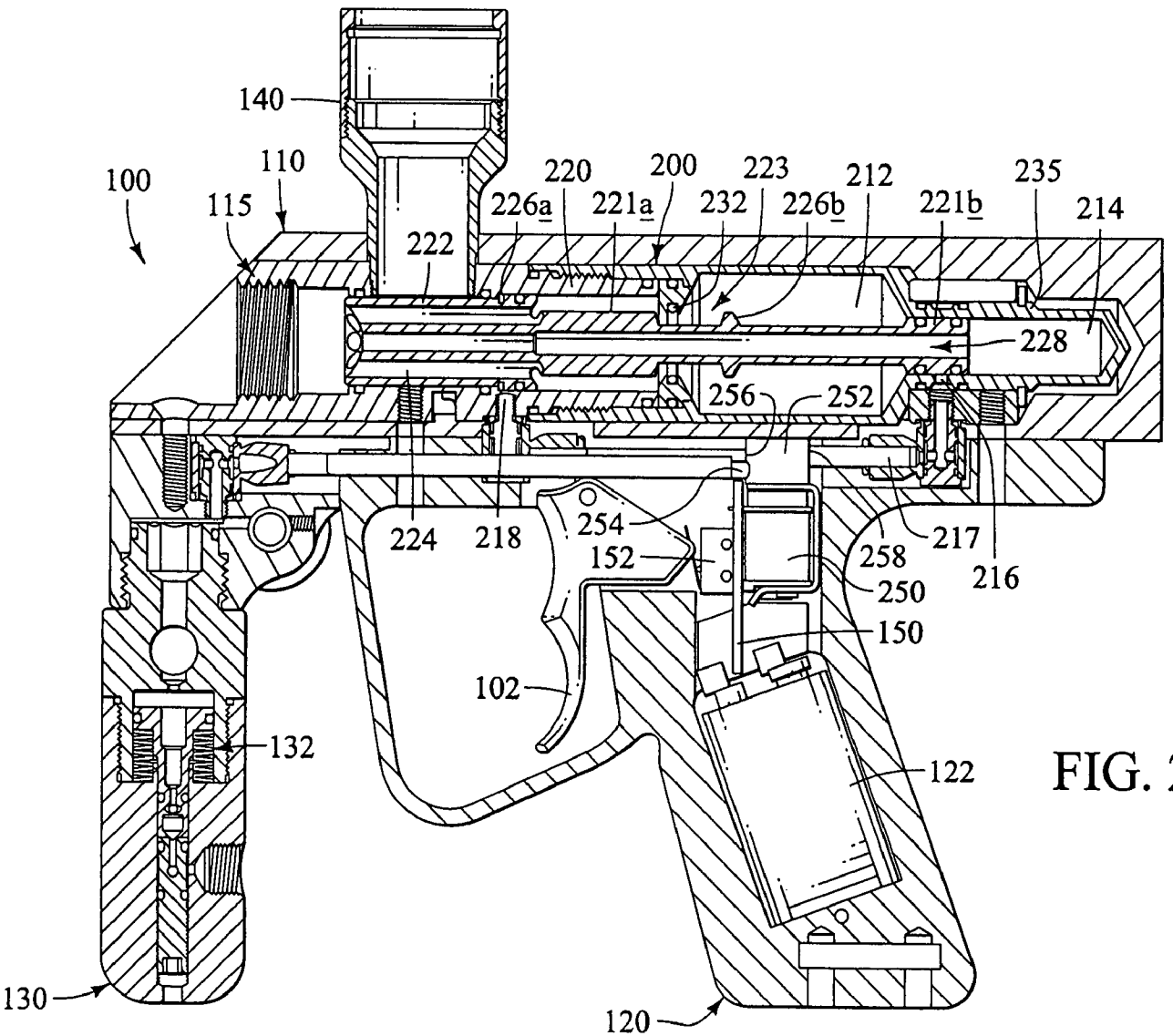
FIG. 2 is a somewhat schematic cross-sectional side view of the paintball gun of FIG. 1, shown with the bolt is disposed in a forward (e.g., closed) position.

Referring now to FIG. 2, with the bolt 222 in the closed position, compressed gas from the compressed gas storage area 212 is permitted to flow into the bolt 222 through channels 223 arranged along an external surface of the bolt 222 and ports 224 arranged to communicate compressed gas from a predetermined location along the exterior of the bolt 222 to a forward end of the bolt 222*a*. While the bolt 222 is in its forward position, entry of compressed gas into the compressed gas storage area 212 from the supply port 216 can be restricted using a glide ring 225*a* arranged on the rearward section of the guide rod 221*b* near a rearward end 222*b* of the bolt 222. A sealing member 225*b* prevents compressed gas from entering the rearward portion of the guide chamber 214 and the vent channel 228. To prevent (rather than restrict) compressed gas from entering into the chamber during the firing operation, the glide ring 225*a* could be replaced by a sealing member (not shown).

Figure 3:
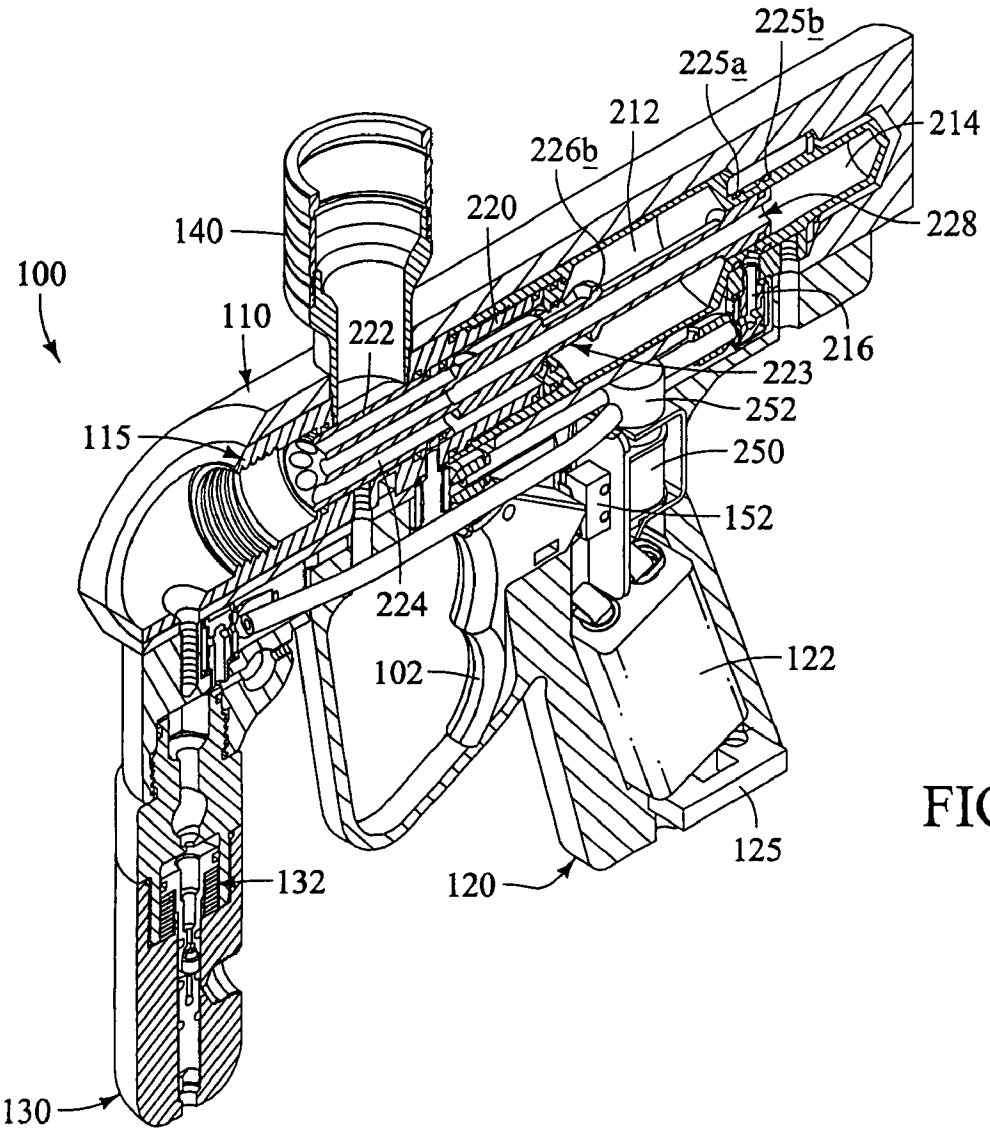
FIG. 3 is a somewhat schematic cross-sectional perspective view of the pneumatic paintball gun illustrated in FIG. 2.

Loading and firing operations of the pneumatic paintball gun 100 will now be described in further detail with reference to FIGS. 1-3. Referring to FIGS. 1, 2, and 3, compressed gas supplied from the regulator 132 to the paintball gun 100 is directed to a manifold 252 arranged in communication with the solenoid valve 250. Compressed gas from the regulator 132 is directed through the manifold to an inlet 254 of the solenoid valve 250. In its normally-open position, the solenoid valve 250 directs compressed gas from the input port 254 to an output port 256 of the manifold 252 to the cylinder 220 and hence the forward bolt piston surface area 226*a*.

Meanwhile, compressed gas from the regulator 132 is also supplied through a second output port 258 of the manifold 252 to a supply port 216, preferably arranged near a rearward end of the compressed gas storage area 212 in a bolt guide cylinder 235. While the bolt 222 is open, compressed gas from the supply port 216 is preferably permitted to rapidly fill the compressed gas storage area 212. A rearward piston surface area 226*b* of the bolt 222 is preferably arranged in or in communication with the compressed gas storage area 212. The forward bolt piston surface area 226*a* is preferably larger than the rearward surface area 226*b*. Thus, in its resting position (e.g., in the absence of a firing signal), the compressed gas supplied to the forward bolt piston surface area 226*a* holds the bolt 222 in an open position against pressure applied to a rearward bolt piston surface area 226*b*. With the bolt 222 in its open (e.g., rearward position), a paintball is permitted to drop from a feed tube 140 into a breech area 145 of the paintball gun 100.

A firing operation of the paintball gun 100 is preferably initiated in response to actuation of a trigger 102. The trigger 102 is preferably configured to initiate a firing operation of the paintball gun 100 through actuation of a microswitch 152 or other switching mechanism when pulled. Actuation of the switching mechanism 152 preferably causes the circuit board 150 to initiate a firing operation by transmitting one or more firing signals to the solenoid valve 250. In the embodiment illustrated in FIGS. 1, 2, and 3, the firing signal is preferably an actuation signal that energizes the solenoid of the solenoid valve 250 for a predetermined duration of time. The trigger 102 could be configured, however to actuate a firing sequence as long as the trigger 102 is pulled, particularly if a mechanical rather than electronic actuation system is utilized.

In response to the firing signal, the solenoid valve 250 preferably vents compressed gas from the forward bolt piston area 226*a*. Pressure applied from the compressed gas storage area 212 to the rearward bolt piston area 226*b* thereby causes the bolt 222 to move to its forward position. As the bolt 222 transitions to its forward position, it forces a paintball that has been loaded in the breech area 145 forward into the rearward end of a barrel (not shown).

In addition, as the bolt 222 approaches its forward position, the channels 223 arranged along the external surface of the bolt 222 slide past the sealing member 232 and allow the compressed gas from the compressed gas storage area 212 to enter into the rearward portion of the cylinder 220. Compressed gas in the rear of the cylinder 220 flows through bolt ports 224 into contact with the paintball in the barrel to cause it to be launched from the gun 100. Also, as the bolt 222 approaches its forward position, a glide ring or sealing member 225*a* slides past the gas supply port 216 to respectively restrict or prevent the flow of compressed gas from the regulator 132 into the compressed gas storage area 212. This can improve the gas efficiency of the paintball gun 100.

Although the embodiment of FIGS. 1, 2, and 3 illustrates the use of an electro-pneumatic valve 250 to control the loading and firing operations of the paintball gun 100, a mechanical valve could be used in place of the solenoid valve 250. Like the solenoid valve 250, the mechanical valve could be configured to supply compressed gas to the forward piston surface area 226*b* through port 218 in a resting position. In response to a pull of the trigger 102, the mechanical valve could be configured to vent the compressed gas away from the forward piston surface area 226*b* to cause the bolt 222 to move forward and perform a firing operation. The trigger 102 could, for example, be directly mechanically coupled to the valve or could communicate with the mechanical valve through one or more intermediate components.

Figure 4:
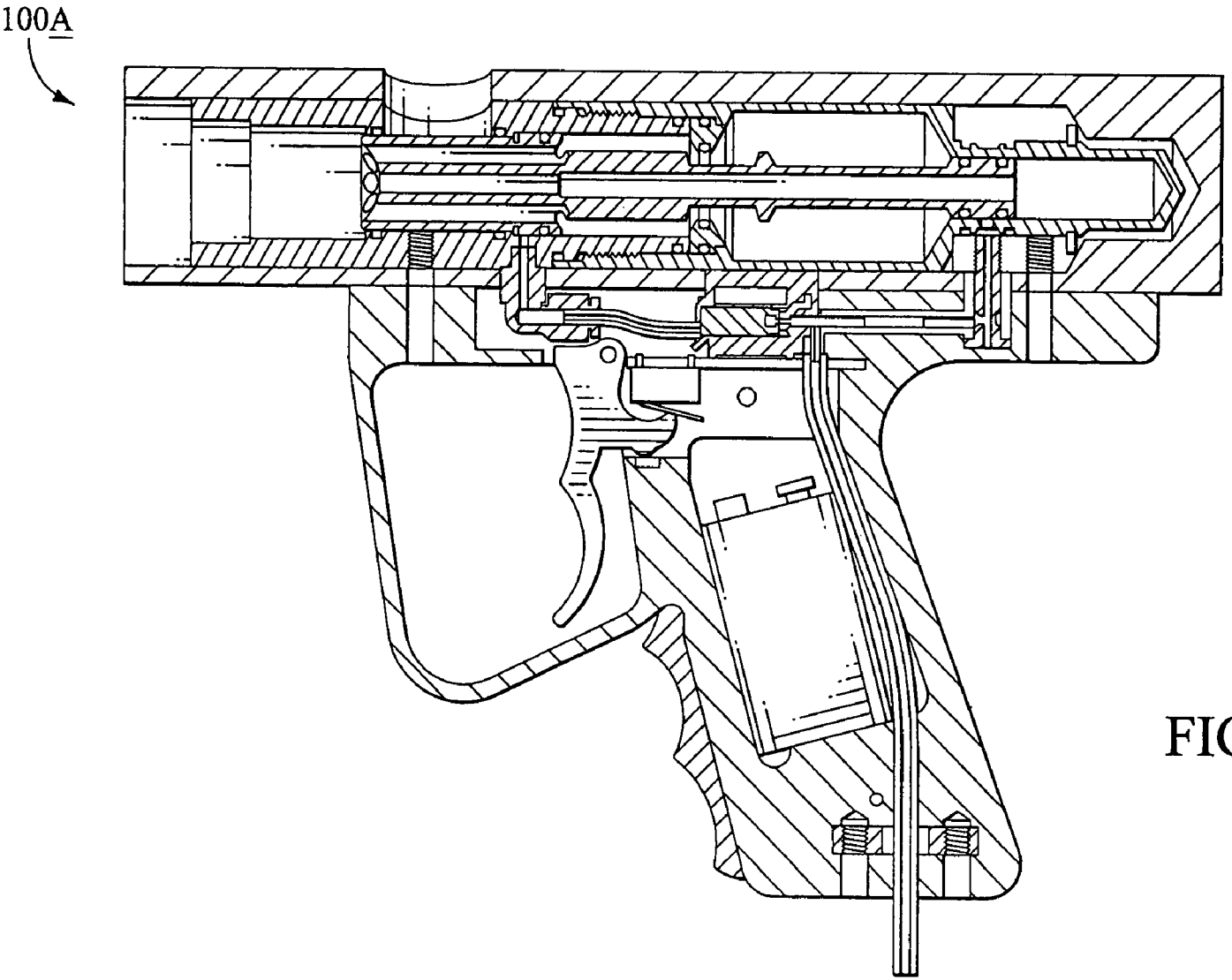
FIG. 4 is a somewhat schematic cross-sectional side view of a paintball gun constructed according to an alternative embodiment of the present invention.
Figure 5:
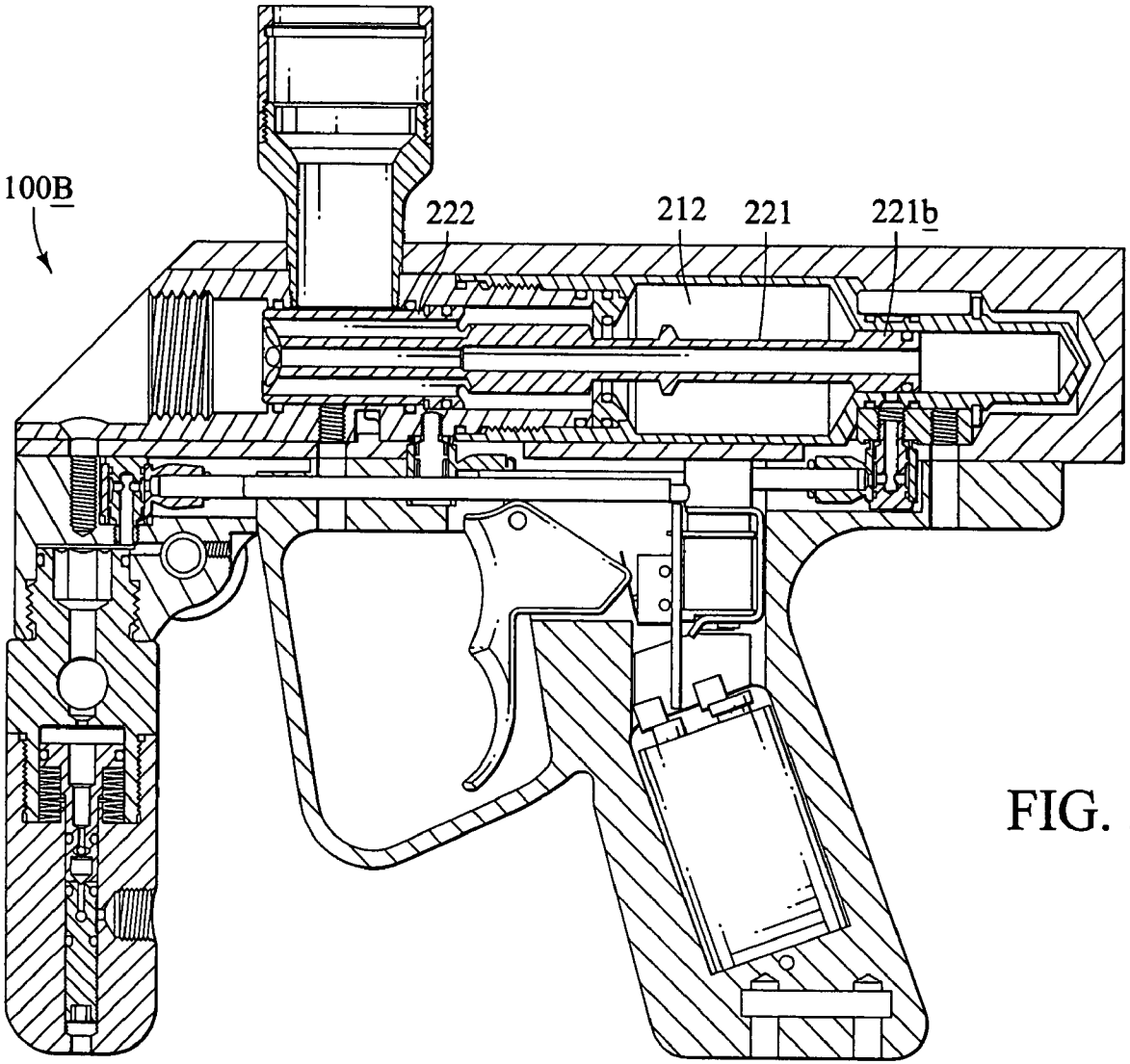
FIG. 5 is a somewhat schematic cross-sectional side view of a paintball gun constructed according to yet another embodiment of the present invention.

Yet other alternative embodiments of the present invention are shown in FIGS. 4 and 5. The paintball gun 100A shown in FIG. 4 is constructed in a manner similar to that shown in FIGS. 1, 2, and 3, except, for instance, the absence of a foregrip 130, compressed gas being supplied to the gun through a tube arranged through the grip 120, and that the solenoid valve 250 is arranged in a different physical relationship with respect to the gun body 110. The primary operating features of this embodiment are essentially the same as that previously described, however, and no additional description of this embodiment will therefore be provided.

The paintball gun 100B depicted in FIG. 5 is also similar to that depicted in FIGS. 1-3, except that the rearward end 221*b* of the guide rod 221 does not contain a glide ring or a sealing ring where the glide ring 225*a* is arranged in the earlier-described embodiment. As with the glide ring, compressed gas is permitted to enter the compressed gas storage chamber 212 even when the bolt is in its forward position. The tolerance between the guide rod 221 and the guide chamber 214 can be configured, however, such that the rate of flow of compressed gas into the compressed gas storage chamber 212 can be restricted while the bolt 222 is arranged in its forward position. This can result in improved gas efficiency and make the bolt 222 easier to move to its retracted position.

Various other alternative embodiments are also contemplated. In particular, rather than use a portion of the bolt 222 to restrict or prevent compressed gas from entering the compressed gas storage area 212, other mechanisms could be used to provide this function. For example, a separate piston could be arranged to slide back and forth in the rearward bolt guide area to block or restrict the supply of compressed gas from the supply port 214 into the compressed gas storage area 212. In yet another potential embodiment, a mechanical, pneumatic, or electro-pneumatic pinching member could be provided to pinch a gas supply tube (e.g., tube 217) to prevent or restrict the flow of compressed gas into the compressed gas storage area 212 while the bolt 222 is in the forward position.

Figure 6:
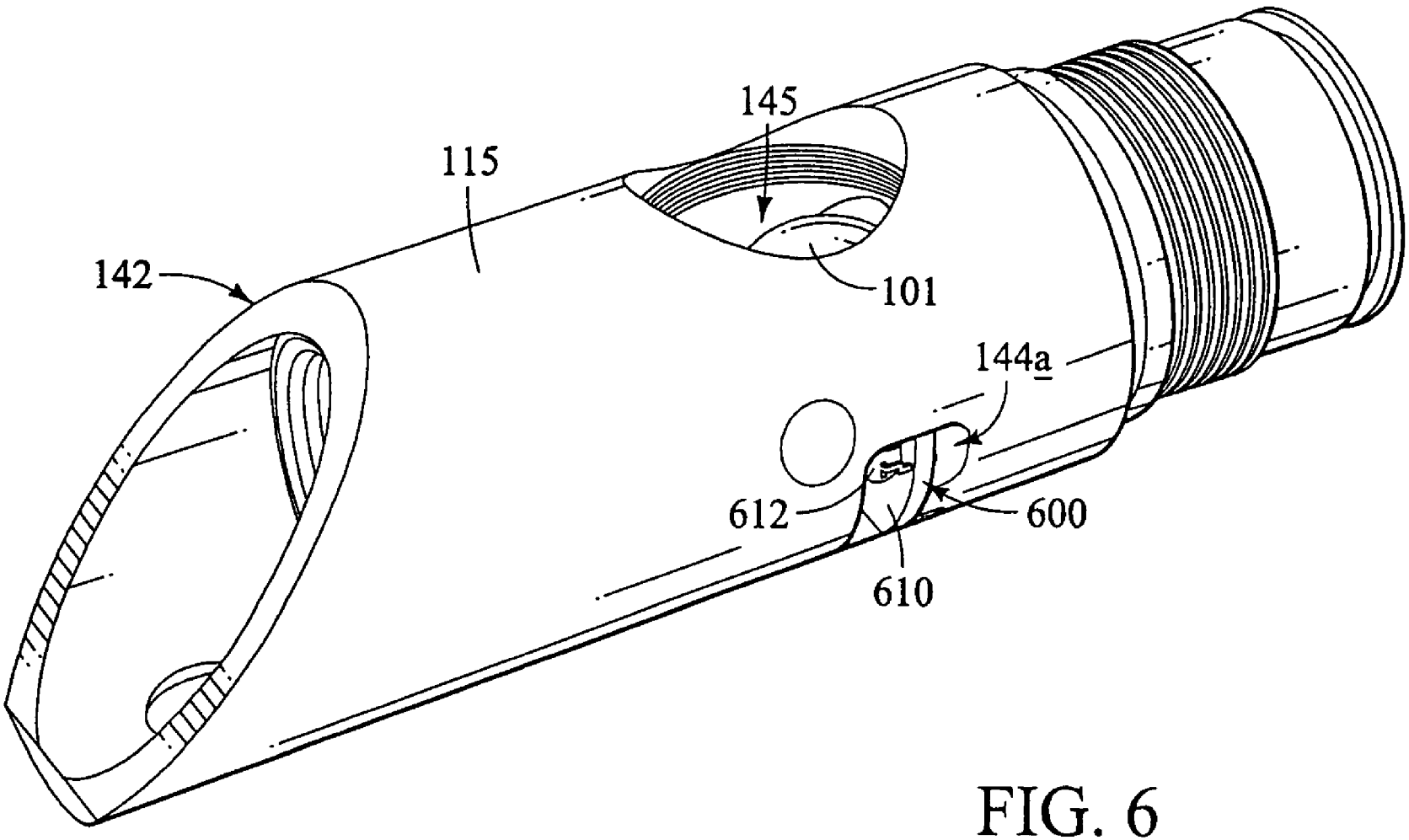
FIGS. 6, 7, and 8 are a somewhat schematic perspective, cross-sectional side, and bottom plan view, respectively, illustrating a paintball detection system arrangement in a breech section of a paintball gun according to yet another embodiment of the present invention.
Figure 7:
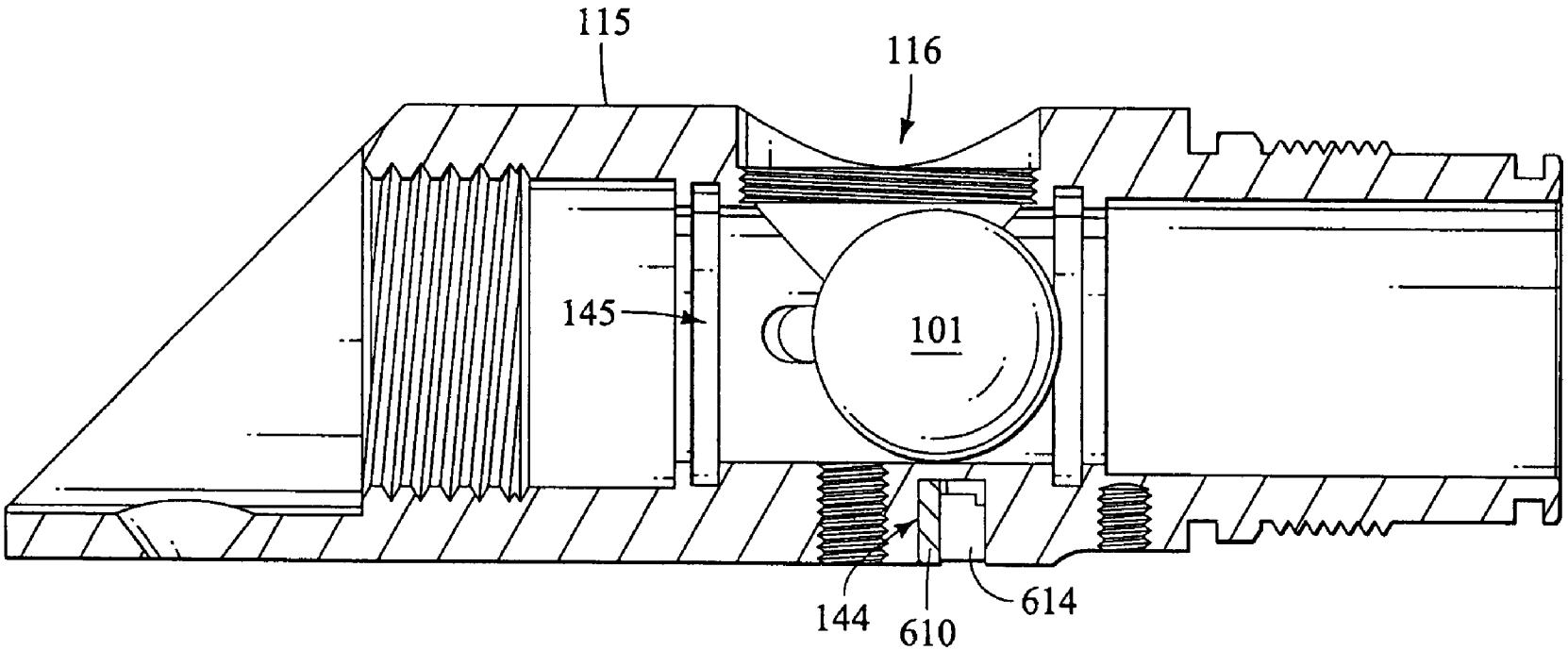
Figure 8:
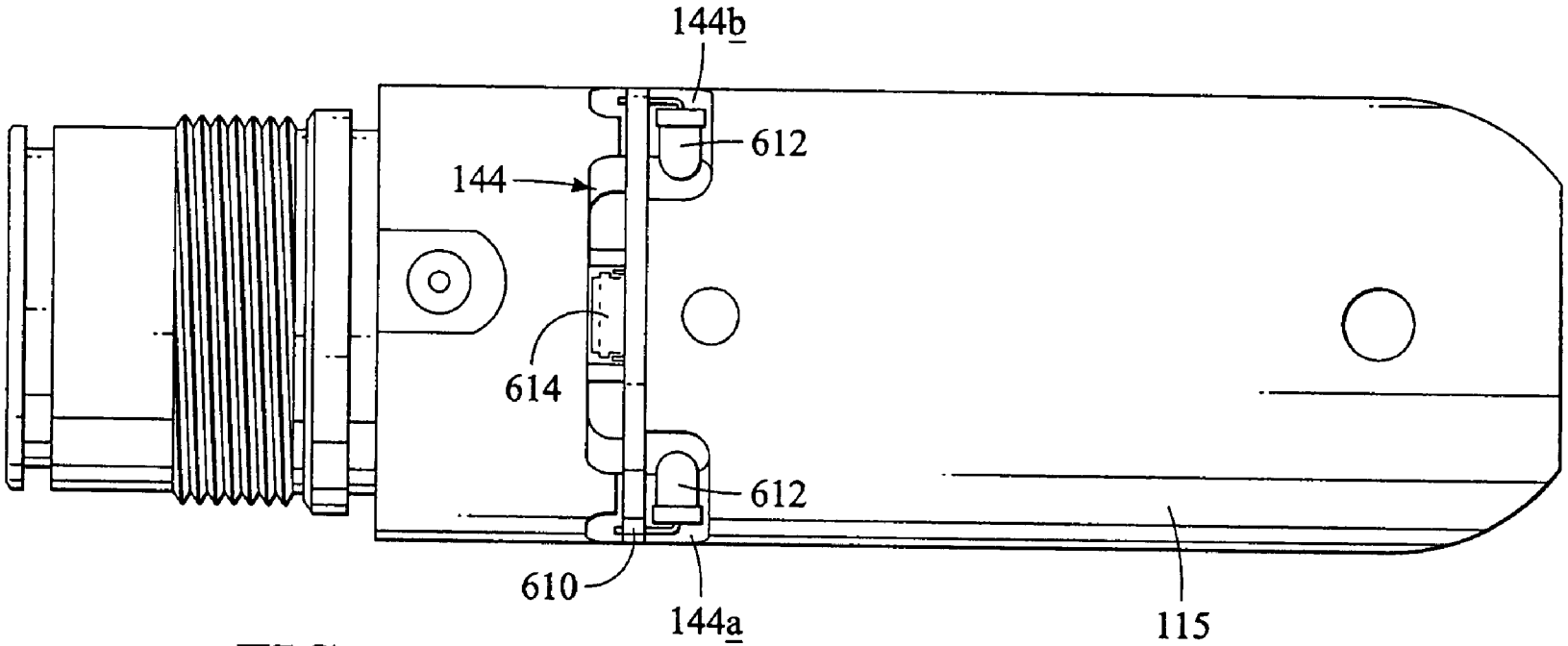

Further aspects of the present invention are illustrated in FIGS. 6, 7, and 8. Referring to FIGS. 6-9, a paintball detection system 600 can be arranged in communication with a breech area 145 of the paintball gun 100 (see FIG. 1). Most preferably, the paintball detection system 600 contains a break-beam sensor arrangement on a circuit board 610. A breech portion 142 of the pneumatic housing 115 of the paintball gun 100 is preferably provided with a recess or a cutout area 144 to receive the circuit board and opposing cutout regions 144*a*, 144*b* located on opposite sides of the breech area 145 that are configured to receive the break-beam sensors 612.

A preferred circuit board 610 and sensor 612 arrangement for the paintball detection system 600 of FIGS. 6, 7, and 8 is shown in FIG. 9. Referring to FIG. 9, the circuit board 610 preferably comprises the circuitry for controlling the break-beam or other sensors 612 and an electronic communications port 614 for communicating with a circuit board 150 of the paintball gun 100 (see FIG. 1) through wiring or wirelessly. The sensors 612 can be mounted directly to the circuit board 610, as illustrated, or can be connected remotely via wires or wirelessly. In a preferred embodiment, the circuit board 610 is configured having a "C" shape with sensors 612 arranged on opposite arms of the circuit board 610. The circuit board 610 is preferably configured to fit within a recess or cutout 144 in the pneumatic housing and locate the sensors 612 within sensor cutout regions 144*a*, 144*b* in the pneumatic housing 115 on opposite sides of the breech area 145. In the preferred break-beam sensor embodiment, the sensors 612 are preferably configured such that one transmits a beam (or other optical or radio signal) to the other sensor 612 until that signal is interrupted by the presence of a paintball 101 in the breech area 145.

Operation of the paintball detection system 600 according to the foregoing embodiment will now be described in further detail with reference to FIGS. 1 and 6-9. Referring to FIGS. 6-9, with the bolt 222 arranged in a rearward position, a paintball 101 is preferably permitted to drop from the feed tube 140 into the breech area 145 of the paintball gun 100 through the feed tube opening 116. As the paintball 101 enters the breech area 145, it breaks a beam transmitted from one of the sensors 612 to the opposing sensor 612. A signal is then preferably generated by the detection system circuit board 610 to indicate that a paintball 101 has been loaded into the paintball gun 100. Alternatively, the detection system circuit board 610 could be configured to send a signal corresponding to the absence of a paintball 101 from the breech area 145.

The detection system circuit board 610 therefore preferably communicates a signal to the paintball gun circuit board 150 to indicate either the presence or the absence of a paintball 101 in the breech area 145 of the paintball gun 100. In response to this signal, the paintball gun circuit board 150 can preferably be configured to either execute or refrain from executing a firing operation in response to a trigger pull. More specifically, if the detection system circuit board 610 indicates the absence of a paintball 101 from the breech area 145 of the paintball gun 100, the paintball gun circuit board 150 is preferably configured to refrain from executing a firing operation in response to a trigger pull. If a paintball 101 is detected in the breech area 145 of the paintball gun 100, however, the paintball gun circuit board 150 is preferably configured to execute the firing operation in response to a trigger pull.

Figure 10:
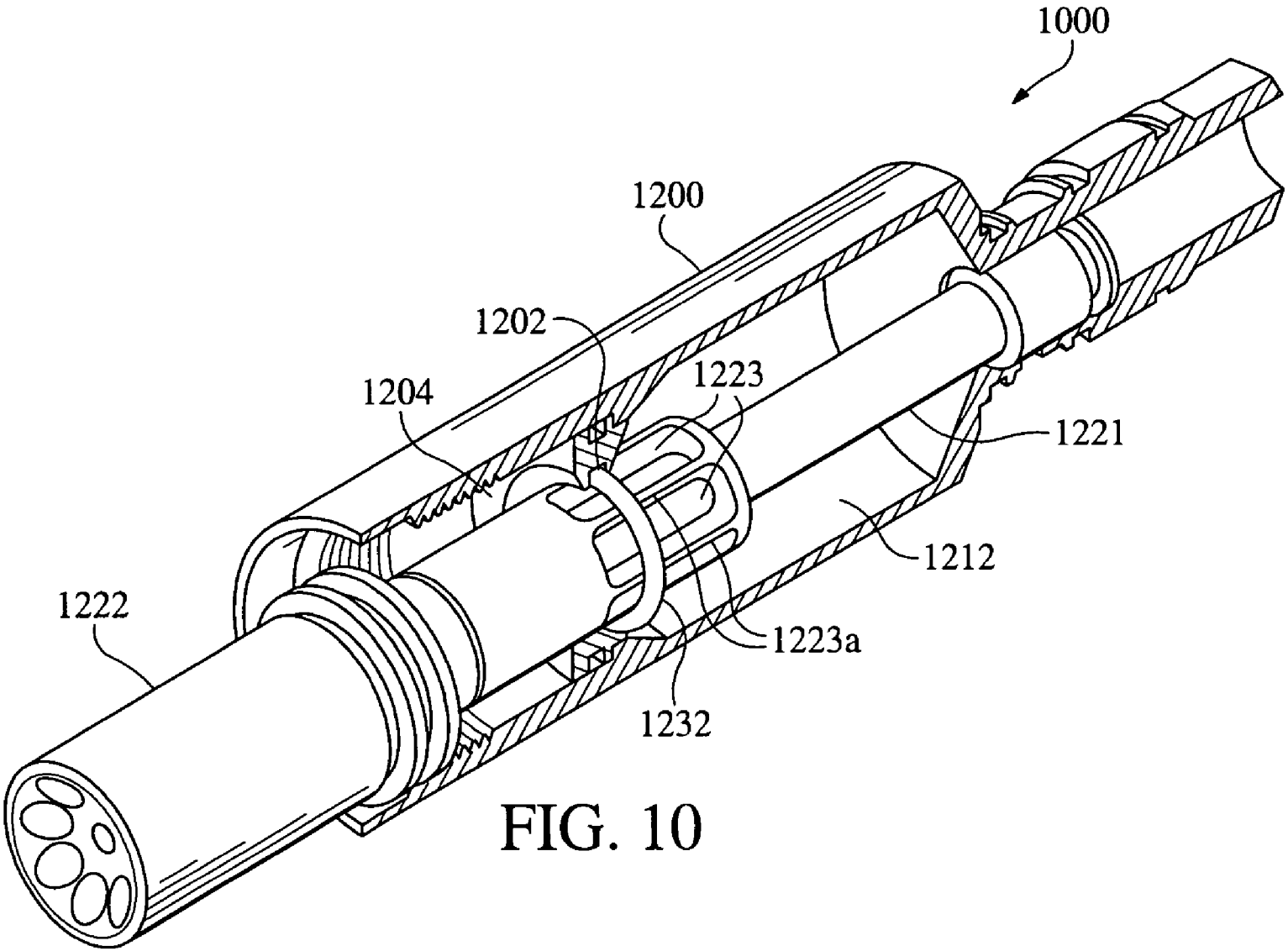
FIG. 10 is a somewhat schematic perspective cross-sectional view of a pneumatic assembly capable of use in the paintball gun of FIG. 1, according to another aspect of the present invention.

FIG. 10 is a somewhat schematic perspective cross-sectional view of a pneumatic assembly 1000 illustrating another aspect of the present invention. Referring to FIG. 10, a plurality of ribs (or fins) 1223*a* can be formed along a firing valve area 1221*a* of the bolt rod 1221 to retain an O-ring 1232 (or other sealing member) in position during a firing operation of the paintball gun (or other pneumatic launching device). As shown, an O-ring 1232 is preferably retained in an O-ring retaining groove 1202 in an O-ring retaining member 1204 to provide a sealing member for selectively preventing and permitting compressed gas to enter the bolt 1222 from a compressed gas storage area 1212. In this embodiment, when the bolt 1222 is in a rearward position, the O-ring 1232 seals around an outer surface of the firing valve area 1221*a* of the bolt rod 1221 to prevent compressed gas from escaping into the bolt 1222. When the bolt 1222 transitions to a forward position during a firing operation, however, firing grooves 1223 arranged between the ribs 1223*a* preferably permit compressed gas to escape from the compressed gas storage area 1212 into the bolt 1222 to be released from the paintball gun and launch a paintball. At the same time, however, the ribs 1223*a* prevent the O-ring 1232 from being unseated from its retaining groove 1202 and collapsing into the firing grooves 1223.

Figure 11:
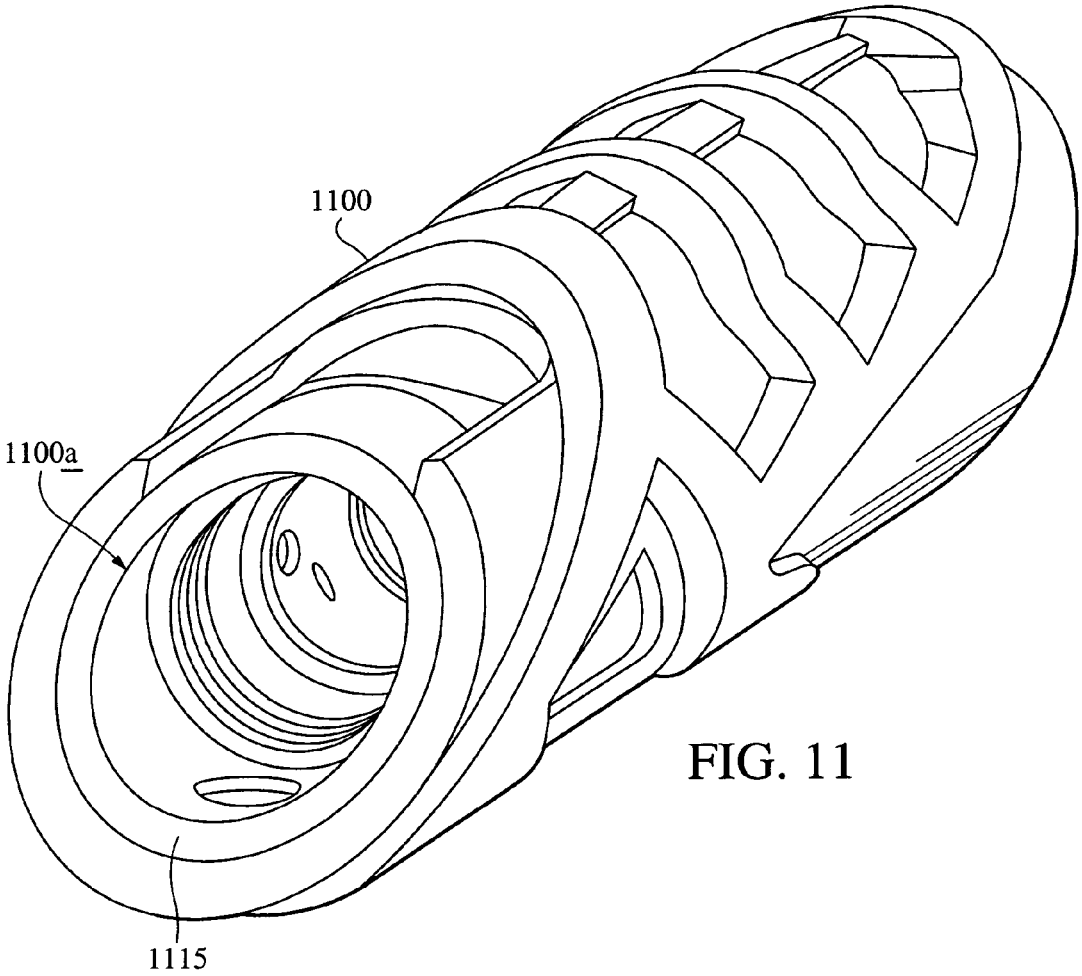
FIG. 11 is a somewhat schematic perspective view of a paintball gun body having an interchangeable external shell, according to yet another aspect of the present invention.
Figure 12:
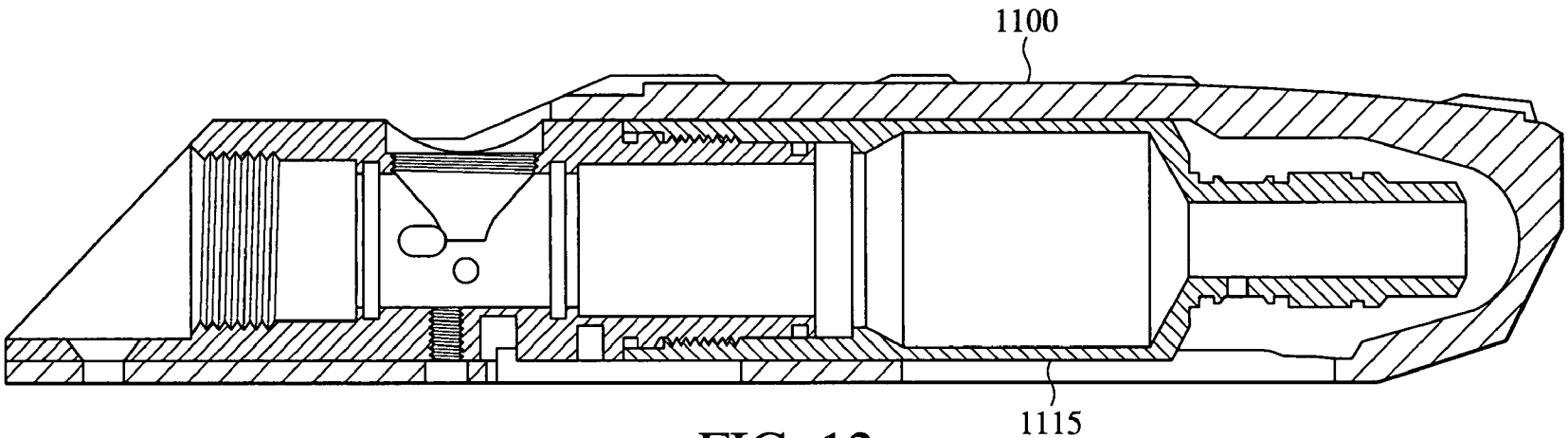
FIG. 12 is a somewhat schematic cross-sectional side view of a paintball gun body with an interchangeable external shell, as shown in FIG. 11.
Figure 13A:
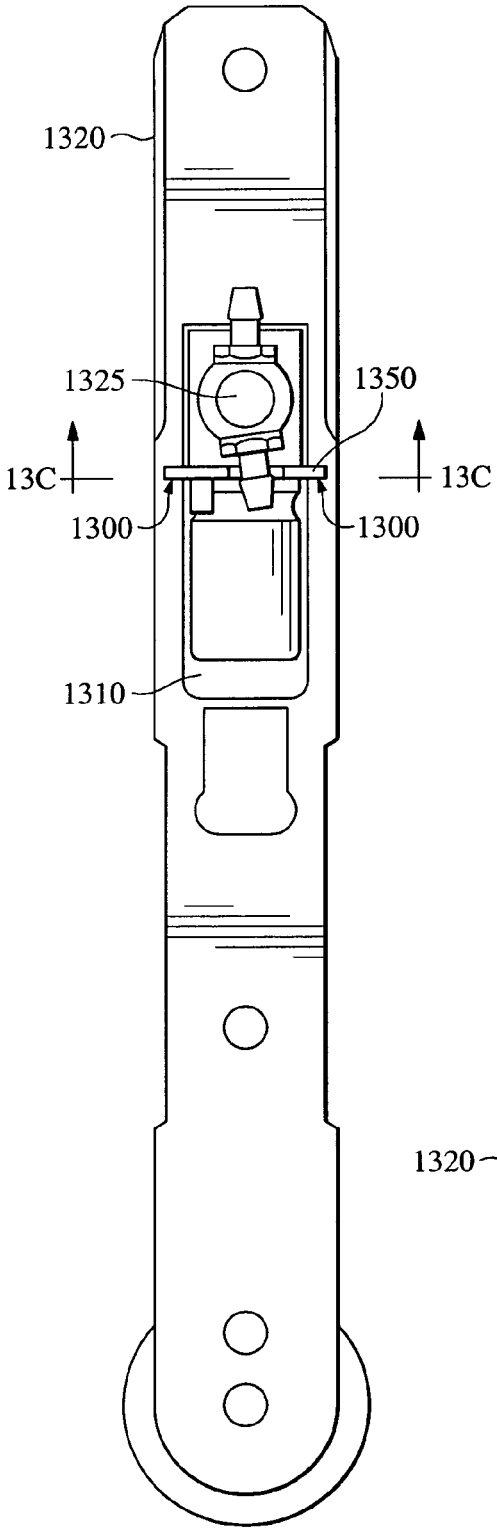
FIG. 13A is a somewhat schematic top view of a paintball gun grip frame configured to receive a grip-mounted circuit board according to a still further aspect of the present invention.
Figure 13B:
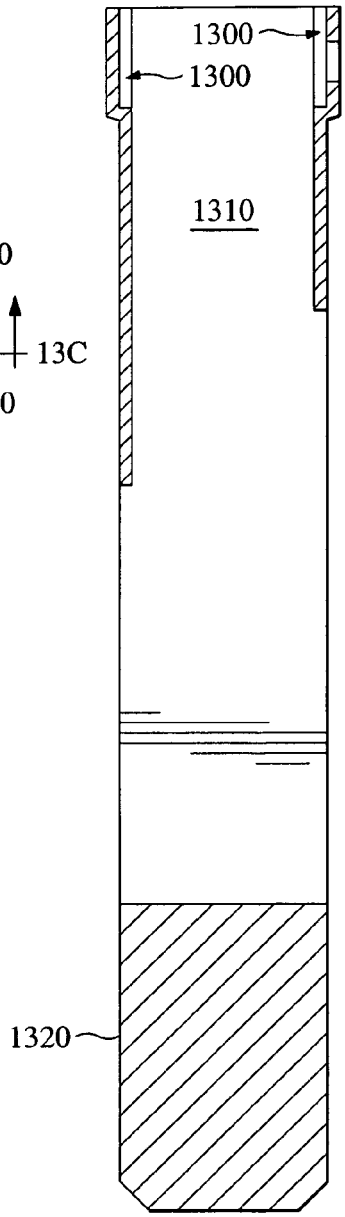
FIG. 13B is a somewhat schematic cross-sectional view of the paintball gun grip frame of FIG.1 3A, illustrating a slot configured to receive a grip-mounted circuit board according to another aspect of the present invention.
Figure 13C:
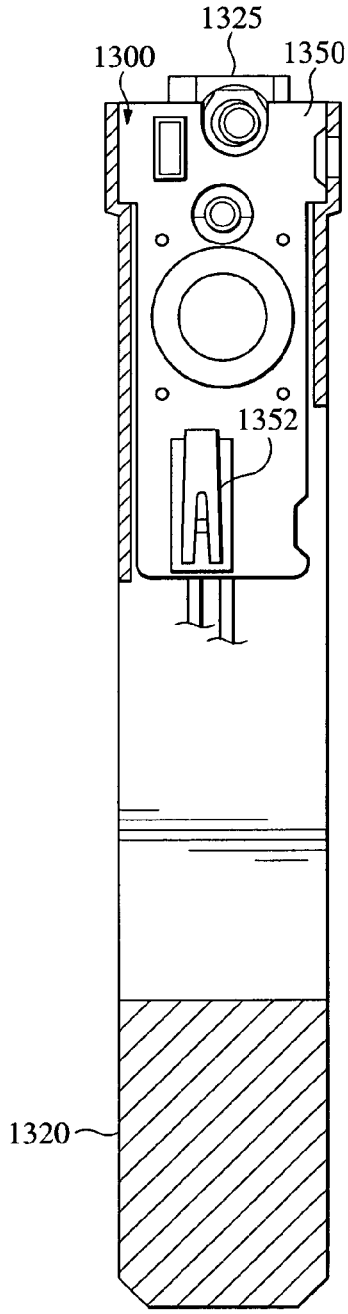
FIG. 13C is a somewhat schematic cross-sectional view of the paintball gun grip frame of FIG. 13A, illustrating a grip-mounted circuit board arranged in the slot of FIG. 13B.
Figure 14:
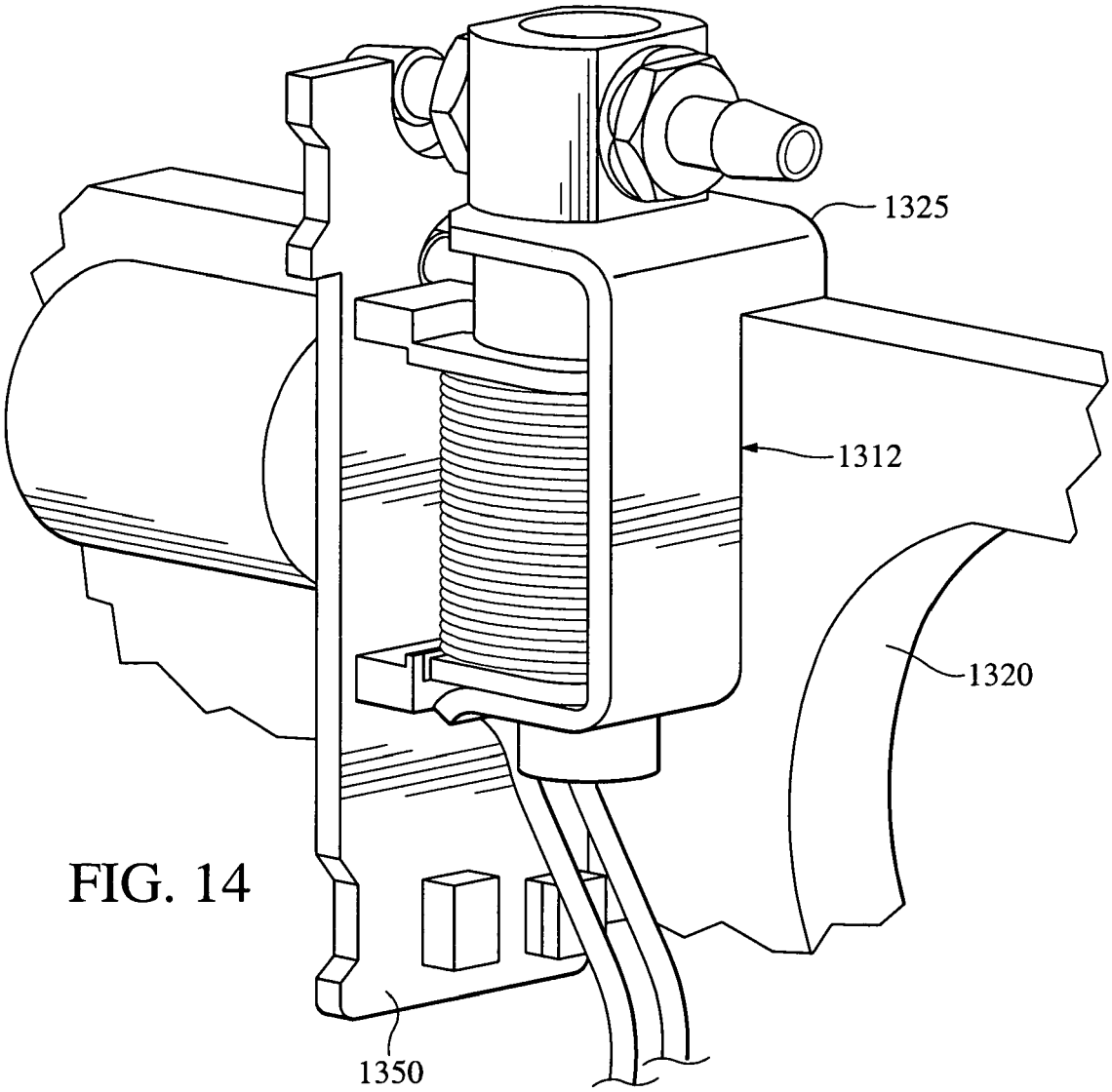
FIG. 14 is a somewhat schematic cross-sectional perspective view of a paintball gun having a grip-mounted circuit board with a solenoid valve arranged thereon.
Figure 15:
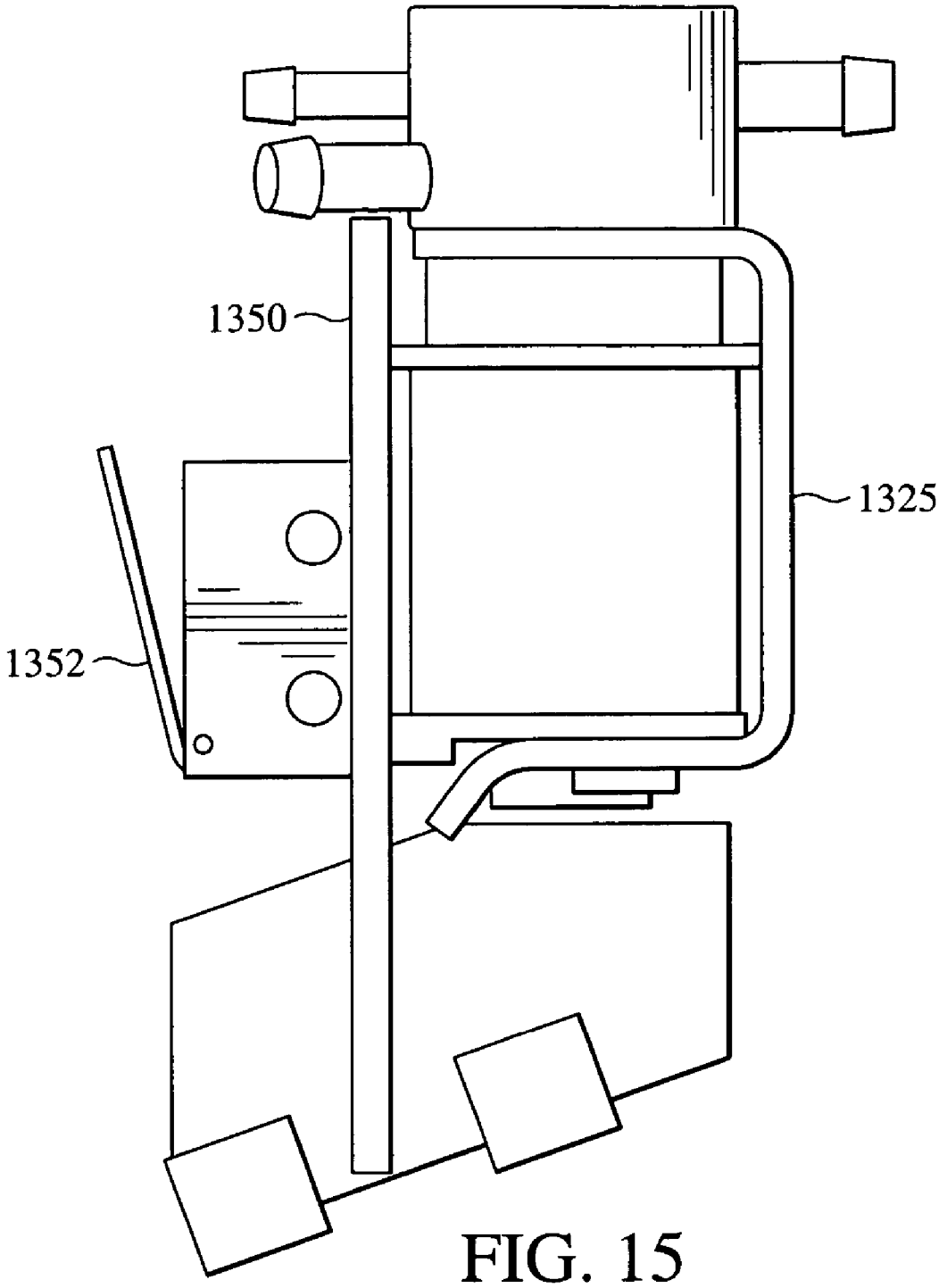
FIG. 15 is a somewhat schematic side view of a circuit board for a paintball gun having a solenoid valve and trigger-actuated microswitch arranged thereon in accordance with yet another aspect of the present invention.

FIGS. 11-12 illustrate another aspect of the present invention. Referring to FIGS. 11-12, according to a further aspect of this invention, an interchangeable shell 1100 can form the outer portion of the paintball gun body surrounding the pneumatic components 1115. The interchangeable shell 1100 can, for instance, be a plastic, metal, or composite material, but is preferably ABS plastic. A number of interchangeable shells can be provided of different shapes, colors, and body styles to permit a user to customize their gun to a desired appearance. The shell 1100 can be mounted to the grip frame, for instance, through one or more screws or other mounting device. The pneumatic components 1115 can be configured to slide into the external shell 1100 through a forward opening 1100*a* thereof.

FIGS. 13A-15 illustrate yet another aspect of the present invention. Referring to FIGS. 13A-15, according to a still further aspect of this invention, an improved apparatus and method for grip mounting a circuit board 1350 can be provided. According to this method, one or more slots 1300 are preferably arranged in the grip frame to receive the circuit board. Most preferably, one slot 1300 is arranged on each side of an opening 1310 on the inside of the grip frame 1320 to receive opposing sides of the circuit board 1350. The depth of the slots 1300 is preferably selected to arrange the circuit board 1350 in the appropriate location when the circuit board 1350 is fully inserted into the slots 1300. The circuit board 1350 and slot 1300 may further have a mating step-like configuration. In this embodiment, no tools or mounting screws are required to secure the circuit board 1350 in the paintball gun, thereby reducing the cost of parts and the cost of manufacturing. Manufacturing consistency is also improved.

A solenoid valve 1325 is preferably mounted on the circuit board 1350 and arranged in the grip 1320 of the paintball gun. A slot 1312 in the grip is preferably sized to securely receive both the circuit board 1350 and the solenoid valve 1325. The circuit board 1350 can further include a trigger-actuated microswitch 1352 arranged on the circuit board 1350, preferably on an opposite side of the circuit board 1350 rom the solenoid valve 1325.

Figure 16:
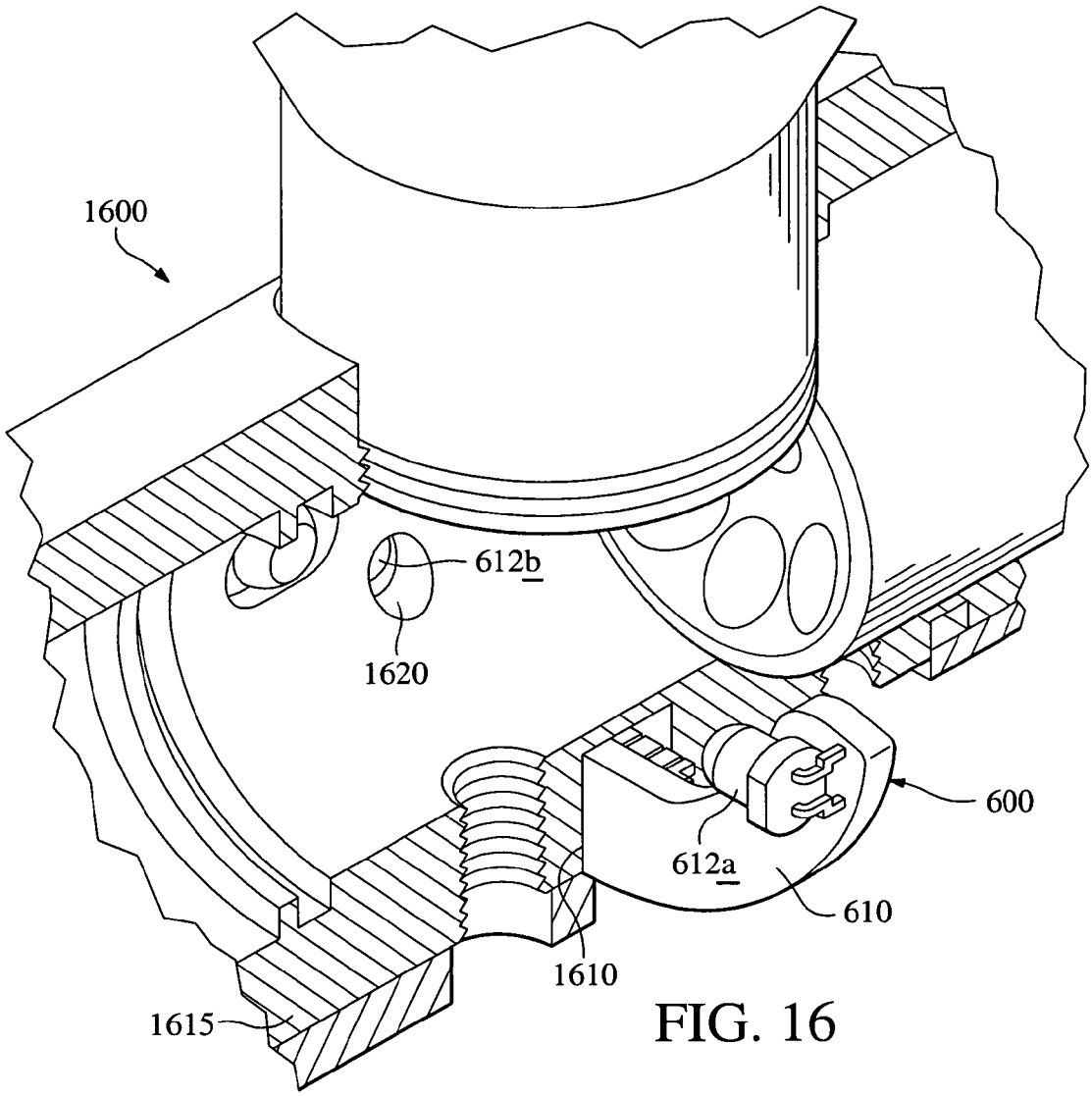
FIG. 16 is a somewhat schematic cross-sectional perspective view of a paintball gun having the paintball detection system of FIGS. 6-9, illustrating a method of mounting the paintball detection system according to another aspect of the present invention.

FIG. 16 is a cross-sectional perspective view of a section of a paintball gun 1600 illustrating a method of mounting a paintball detection system according to another aspect of the present invention. A method of mounting a paintball detection system 600 is provided. According to this method, a mounting slot 1610 is preferably arranged in a bottom portion of a pneumatic housing 1615 near a breech area of a paintball gun 1600. Holes or slots 1610 are preferably arranged through one or more sidewalls of the pneumatic housing 1615 at the breech area. A paintball detection system circuit board 610 is preferably mounted within the slot 1610 such that a sensor 612*a* disposed on the circuit board 610 can communicate with an interior of the breech area or with a sensor 612*b* arranged on an opposite side of the pneumatic housing 1615. The circuit board 610 is preferably shaped to fit within the mounting slot 1610. If a break-beam sensor system is used, holes 1620 are preferably arranged in opposing sides of the pneumatic housing 1615 in proximity to the location of the break-beam sensors once installed in the pneumatic housing 1615.

According to a further aspect of the present invention, a paintball gun can be arranged and sold to consumers in component or "kit" form. The paintball gun kit can be sold as a complete package, having all of the necessary components for the paintball gun, or it can be sold in multiple packages, each package having one or more of the parts necessary for completion, upgrade, or maintenance of the paintball gun. Providing a "kit" form of a paintball gun also allows for greater user customization, multiple packaging configurations, and a greater variety in price points to consumers. The paintball gun kits could be sold in partially assembled or completely disassembled forms. The paintball gun kits could further be sold in many different configurations, with different upgrade options, body styles, material components, etc., in order to meet the desires and price ranges of a wider variety of consumers.

Figure 17:
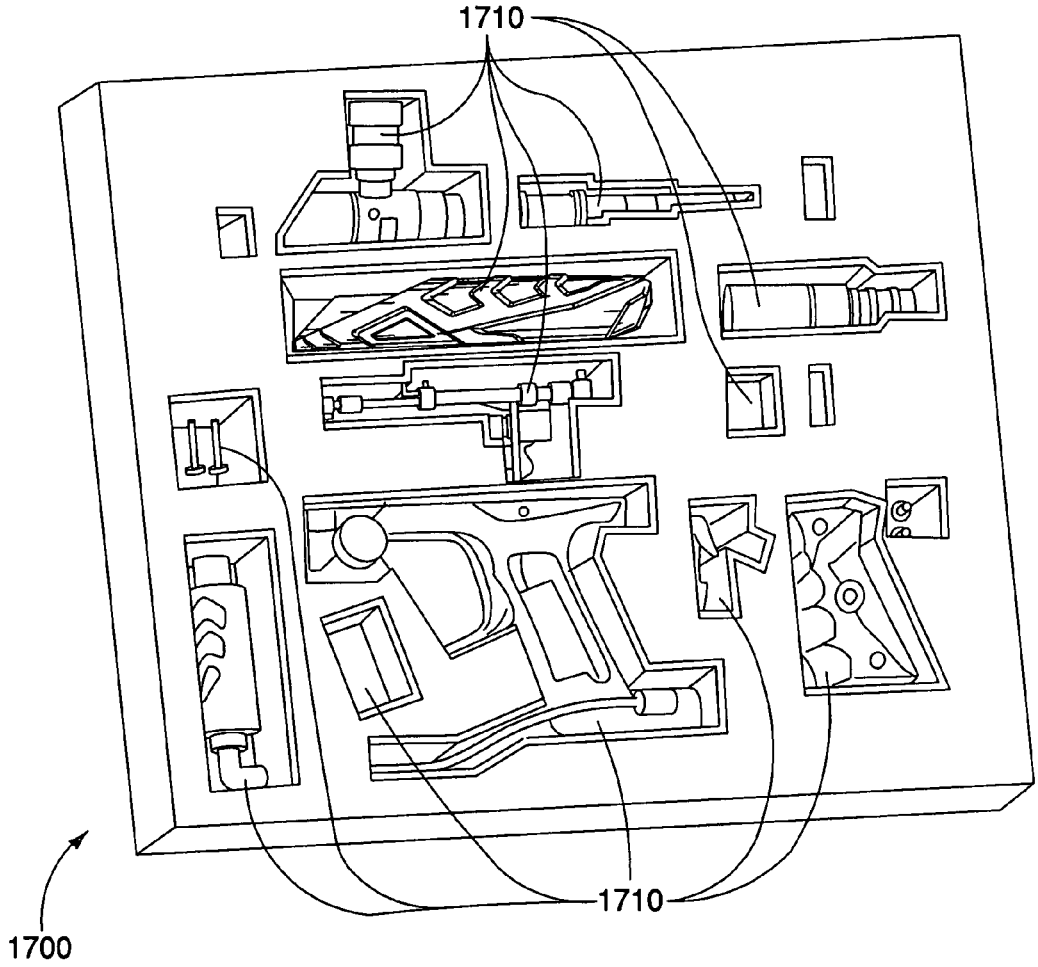
FIG. 17 is a somewhat schematic illustration of a paintball gun kit according to yet another aspect of the present invention.
Figure 18:
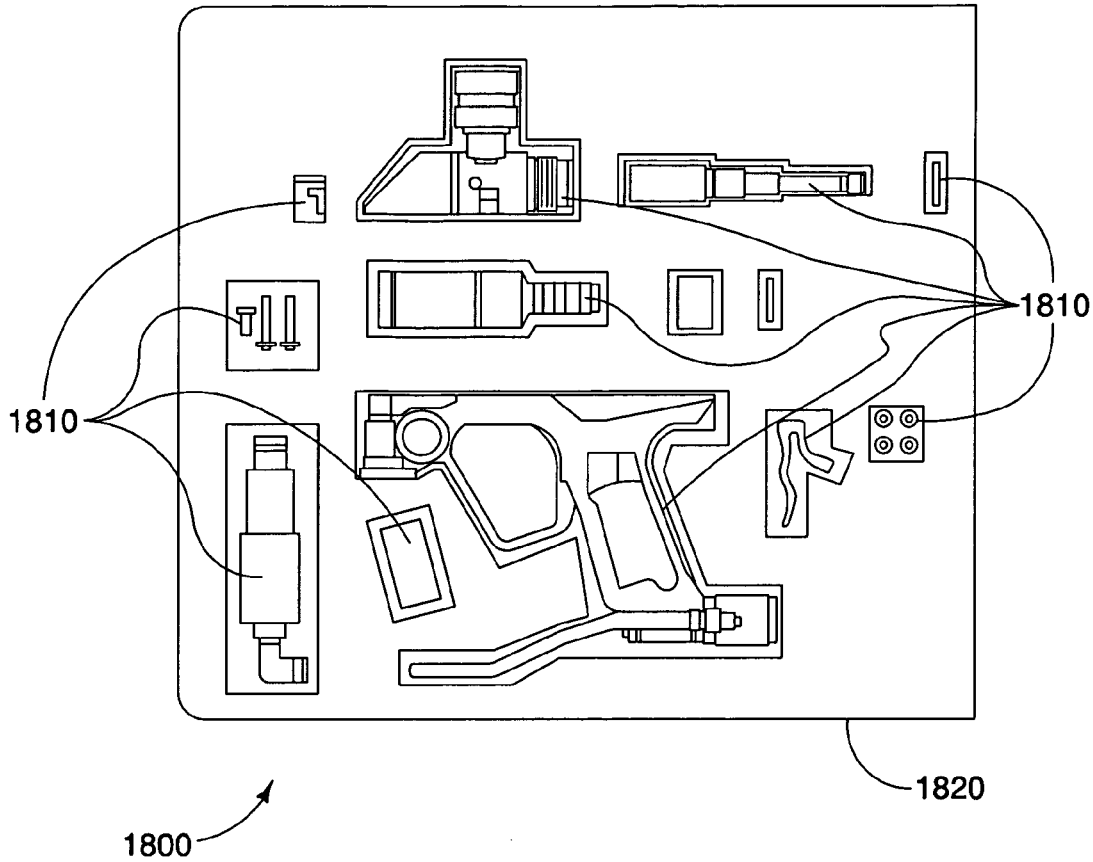
FIG. 18 is a somewhat schematic illustration of a paintball gun kit package according to a still further aspect of the present invention.
Figure 18:
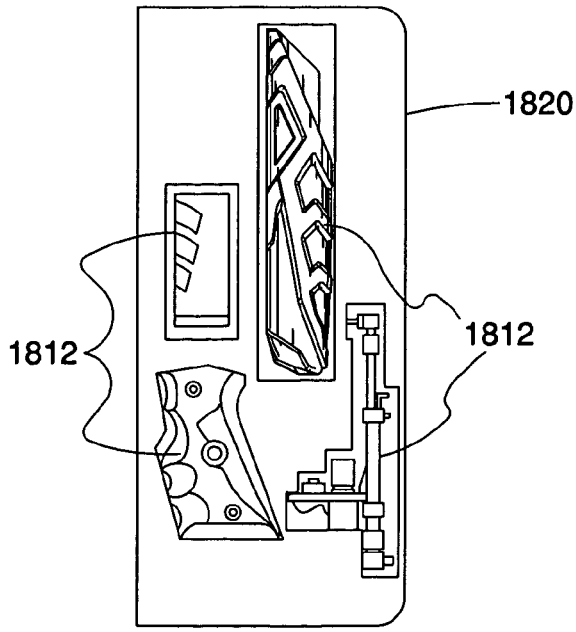
Figure 19:
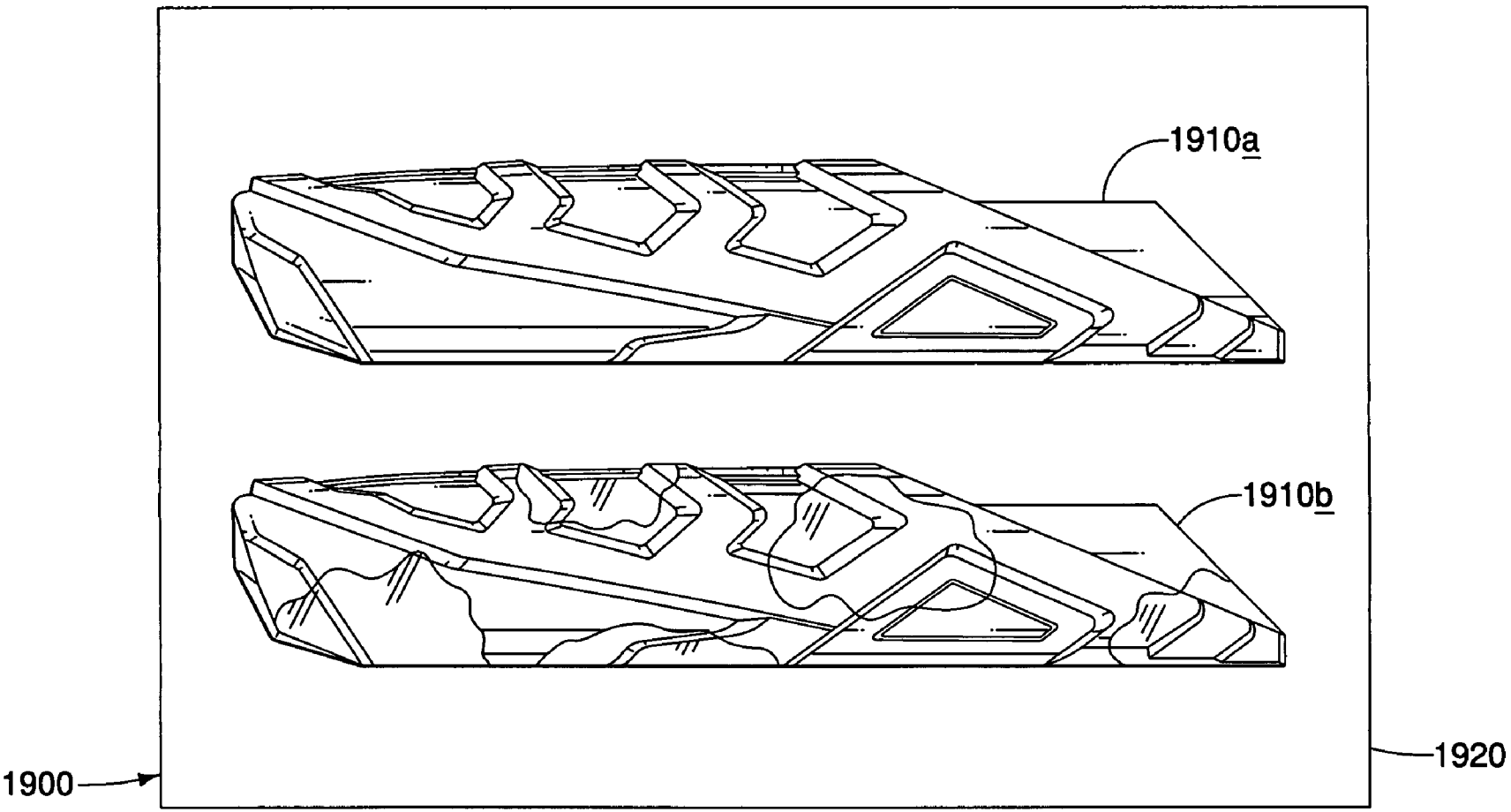
FIG. 19 is a somewhat schematic illustration of a paintball gun kit package according to a still further embodiment of the present invention.

FIGS. 17-19 are schematic illustrations showing a few of the many various paintball gun kit arrangements that can be provided to consumers. Referring to FIG. 17, according to one embodiment of the present invention, a paintball gun kit 1700 includes all of the necessary components 1710 for an end user to construct a paintball gun. In this particular embodiment, the paintball gun kit 1700 is sold with the paintball gun in partially assembled form to reduce the amount of assembly by the end user. Alternatively, however, the paintball gun kit 1700 could be sold in any degree of completion ranging from completely unassembled to nearly fully assembled. Instructions (not shown) are preferably provided in sufficient detail to permit the consumer to properly assemble the paintball gun.

By allowing the user to participate in the assembly of the paintball gun, the user is able to gain an increased familiarity with the paintball gun and its manner of construction and operation. The paintball gun will thereby be easier for them to troubleshoot and maintain. Reduction in labor costs provided by removing assembly from the manufacturing process further allows those savings to be passed on to the consumer and the gun kit 1700 can be sold for a lower price than the fully-constructed marker.

FIG. 18 illustrates yet another form of paintball gun kit 1800 that can be sold to a consumer. Referring to FIG. 18, a paintball gun kit 1800 can comprise multiple packages 1820, each containing one or more of the paintball gun components 1810, 1812. Each package 1820 is preferably configured and labeled to be sold separately from the other package(s). A retailer could also elect, however, to sell the packages together. This option provides greater flexibility to a retailer in terms of product offerings and to consumers in terms of the specific configuration and customization of their paintball marker.

For instance, various body styles and materials can be provided to allow the consumer to customize the external look of their paintball gun. Bodies of countless styles, shapes, colors, materials, etc. can provide endless possibilities in terms of appearance, durability, weight, and cost. Similarly, various trigger types and styles could be provided to allow the user to customize the look and feel of their trigger. Likewise, different size and style grip frames, feed tubes, grips and other cosmetic and functional components can be provided to allow the user to construct and build a paintball gun according to their own individual requirements and tastes.

Additionally, internal operating components of various materials can be provided having different benefits and advantages. For instance, internal components such as the bolt or internal cylinders can be provided in metal for durability, with the same components also being supplied in a plastic or composite material with lighter weight. The same components could also be supplied in any other suitable material to provide other beneficial characteristics. In this manner, an almost endless combination of component options can be provided to consumers to permit them to completely customize and assemble their paintball marker according to their own personal needs and preferences.

FIG. 19 illustrates a further configuration of a paintball gun kit 1900. As shown in FIG. 19, a kit 1900 can include multiple configurations of the same component 1910 in a single package 1920 to allow a consumer to customize their paintball gun in multiple ways depending on their particular needs or desires. For instance, as represented in FIG. 19, a kit package 1920 can include multiple body styles, colors, shapes, etc. to permit a user to configure and reconfigure their paintball gun in many different ways depending upon their needs and/or desires. By providing multiple body styles, for example, a user could use a camouflage body style 1910*b* for woods play and a colored body 1910*a* for X-ball or similar play, thus satisfying multiple needs or desires of a consumer in a single commercial package.

Similarly, multiple grip, grip frame, bolt, trigger, feed neck, and other paintball gun components could be supplied together in packages in any combination to permit a user to select the package that best meets their desired gun design and style of play. Various circuit board configurations having different features can also be supplied for electronic paintball guns.

As described above, in addition to permitting users to become more knowledgeable on the construction and operation of their paintball guns, paintball gun kits according to various aspects of the present invention can provide consumers with greater flexibility in the design, appearance, and features of their paintball gun.

Having described and illustrated various principles of the present invention through descriptions of exemplary preferred embodiments thereof, it will be readily apparent to those skilled in the art that these embodiments can be modified in arrangement and detail without departing from the inventive principles made apparent herein. The claims should therefore be interpreted to cover all such variations and modifications.

What is claimed is:

1. A paintball gun kit, comprising:

a plurality of paintball gun components packaged together for retail sale to consumers in a non-fully assembled form; and wherein the plurality of paintball gun components comprises a grip frame and a pneumatic housing packaged together in a single package but not assembled together with each other.

2. A paintball gun kit according to claim 1, wherein the plurality of paintball gun components further comprises a bolt packaged together with the grip frame and the pneumatic housing, but not assembled together with the pneumatic housing of the paintball gun.

3. A paintball gun kit according to claim 2, wherein the plurality of paintball gun components further comprises:

a trigger;

an electronic circuit board; and a solenoid valve, wherein the trigger, the electronic circuit board, and the solenoid valve are all packaged together in a single package with the grip frame but are not assembled together with the grip frame.

4. A paintball gun kit according to claim 1, wherein the plurality of paintball gun components further comprises:

a bolt sized to fit within the pneumatic housing; and an external housing shell sized to receive the pneumatic housing therein, wherein the bolt, the pneumatic housing, and the external housing shell are all packaged together in a single package but are not assembled together with each other.

5. A paintball gun kit according to claim 4, wherein the plurality of paintball gun components further comprises:

a circuit board comprising edges sized and arranged to be slot-mounted in a slot in the grip frame; and a solenoid valve, wherein the circuit board and solenoid valve are arranged in a single package with the grip frame, the bolt, the pneumatic housing, and the external housing shell, but are not assembled together with the grip frame or the pneumatic housing.

6. A paintball gun kit, comprising: a plurality of paintball gun components comprising at least a grip frame and a paintball gun body, wherein the grip frame and paintball gun body are packaged together for retail sale but are not assembled together.

7. A paintball gun kit according to claim 6, wherein the plurality of paintball gun components further comprises a trigger, a circuit board, and a solenoid valve, and wherein one or more of the plurality of paintball gun components are packaged and sold separately from one or more of the other of the plurality of paintball gun components, and wherein each of the plurality of paintball gun components is required to be assembled together with the other plurality of paintball gun components to construct a paintball gun capable of operating to fire paintballs.

8. A paintball gun kit according to claim 6, wherein the plurality of paintball gun components comprise all of the components that must be assembled together to construct a paintball gun capable of operating to launch paintballs therefrom.

9. A paintball gun kit according to claim 6, wherein the plurality of paintball gun components further comprise a bolt packaged together with the other components but not assembled together with the other components.

10. A paintball gun kit according to claim 6, wherein the paintball gun body comprises a pneumatic housing and an external housing shell that are packaged together but not assembled together.

11. A paintball gun kit, comprising:

a plurality of paintball gun components comprising a grip frame and a paintball gun body, wherein the grip frame and the paintball gun body are not assembled together; and a single packaging housing the plurality of paintball gun components for sale to a consumer.

12. A paintball gun kit according to claim 11, further comprising assembly instructions for instructing a user on how to assemble the plurality of paintball gun components together into a paintball gun capable of operating to launch a paintball, wherein the assembly instructions are packaged together with the plurality of paintball gun components.

13. A paintball gun kit according to claim 11, wherein the paintball gun components further comprise a pneumatic assembly sized to fit within the paintball gun body but not assembled into the paintball gun body.

14. A paintball gun according to claim 11, wherein the paintball gun body comprises a pneumatic housing and a removable external shell sized to house the pneumatic housing therein, wherein the pneumatic housing and the removable external shell are not assembled together.

* * * * *